US011236431B2

(12) United States Patent
Iimori et al.

(10) Patent No.: US 11,236,431 B2
(45) Date of Patent: Feb. 1, 2022

(54) ELECTROPLATING METHOD

(71) Applicant: YKK Corporation, Tokyo (JP)

(72) Inventors: Masayuki Iimori, Toyama (JP); Ryosuke Takeda, Toyama (JP)

(73) Assignee: YKK Corporation, Tokyo (JP)

( * ) Notice: Subject to any disclaimer, the term of this patent is extended or adjusted under 35 U.S.C. 154(b) by 55 days.

(21) Appl. No.: 16/495,733

(22) PCT Filed: May 11, 2017

(86) PCT No.: PCT/JP2017/017949
§ 371 (c)(1),
(2) Date: Sep. 19, 2019

(87) PCT Pub. No.: WO2018/189916
PCT Pub. Date: Oct. 18, 2018

(65) Prior Publication Data

US 2020/0095700 A1 Mar. 26, 2020

(30) Foreign Application Priority Data

Apr. 14, 2017 (WO) ..... PCT/JP2017/015365

(51) Int. Cl.
*C25D 5/10* (2006.01)
*C25D 3/56* (2006.01)
(Continued)

(52) U.S. Cl.
CPC ..... *C25D 5/10* (2013.01); *C25D 3/56* (2013.01); *C25D 3/58* (2013.01); *C25D 3/60* (2013.01);
(Continued)

(58) Field of Classification Search
CPC ..... C25D 17/16; C25D 17/18; C25D 17/22; A44B 1/02
See application file for complete search history.

(56) References Cited

U.S. PATENT DOCUMENTS 4,908,106 A * 3/1990 Takeshima ..... C25D 5/08 205/148
5,911,865 A 6/1999 Yih
(Continued)

FOREIGN PATENT DOCUMENTS

CN 101954618 A 1/2011
JP H01-139799 A 6/1989
(Continued)

OTHER PUBLICATIONS

International Search Report, PCT Application No. PCT/JP2017/017949, dated Jun. 6, 2017.
(Continued)

*Primary Examiner* — Ho-Sung Chung
(74) *Attorney, Agent, or Firm* — Kilpatrick Townsend & Stockton LLP

(57) ABSTRACT

A method includes: agitating base members that has been immersed in an electrolytic solution inside of an electroplating tank so as to flow in a circumference direction along an inner wall of the electroplating tank; and electroplating the base members flowing along the circumference direction in the electrolytic solution inside of the electroplating tank. The flow of the base members along the circumference direction is caused by a flow of magnetic media along the circumference direction in the electrolytic solution inside of the electroplating tank or is caused by rotation of an agitation unit provided at a bottom side of the electroplating tank. At least one of the base members touches a bottom cathode, and a base member positioned upward relative to the base member touching the bottom cathode is electrically connected to the bottom cathode via at least the base member touching the bottom cathode.

11 Claims, 23 Drawing Sheets

(51) Int. Cl.

| | |
|---|---|
| ***C25D 7/02*** | (2006.01) |
| ***C25D 17/16*** | (2006.01) |
| ***C25D 3/58*** | (2006.01) |
| ***C25D 3/60*** | (2006.01) |
| ***A44B 19/26*** | (2006.01) |
| ***C25D 5/00*** | (2006.01) |

(52) U.S. Cl.
CPC ..... *C25D 5/006* (2013.01); *C25D 7/02* (2013.01); *C25D 17/16* (2013.01); *A44B 19/26* (2013.01)

(56) References Cited

U.S. PATENT DOCUMENTS

| | | | | |
|---|---|---|---|---|
| 6,010,610 | A * | 1/2000 | Yih | C25D 7/006 205/149 |
| 2003/0178313 | A1* | 9/2003 | Tanaka | H01L 24/13 205/74 |
| 2005/0211461 | A1 | 9/2005 | Horikoshi et al. | |
| 2008/0316715 | A1 | 12/2008 | Fujii | |
| 2009/0145772 | A1 | 6/2009 | Zhang et al. | |
| 2012/0245019 | A1* | 9/2012 | Adzic | C25D 17/10 502/5 |
| 2013/0282917 | A1 | 10/2013 | Reznik et al. | |
| 2014/0017512 | A1 | 1/2014 | Iimori et al. | |
| 2016/0024663 | A1 | 1/2016 | Lomasney | |
| 2017/0321341 | A1* | 11/2017 | Hasegawa | C25D 5/22 |

FOREIGN PATENT DOCUMENTS

| | | | |
|---|---|---|---|
| JP | H07-173690 | A | 7/1995 |
| JP | 11-350199 | A | 12/1999 |
| JP | 2002-42556 | A | 2/2002 |
| JP | 2009-171472 | A | 7/2009 |
| JP | 4725051 | B2 | 7/2011 |
| JP | 2012-62566 | A | 3/2012 |
| JP | 2012-87388 | A | 5/2012 |
| JP | 2013-119650 | A | 6/2013 |
| JP | 2014-19953 | | 2/2014 |
| JP | 2014-070265 | A | 4/2014 |
| JP | 2015-63711 | A | 4/2015 |
| JP | 2015-518350 | A | 6/2015 |
| JP | 5741944 | B2 | 7/2015 |
| JP | 2016-084492 | A | 5/2016 |
| KR | 2007-0037494 | A | 4/2007 |
| WO | 2013/141166 | A1 | 9/2013 |
| WO | 2016/075828 | A1 | 5/2016 |
| WO | WO-2016075828 | A1 * | 5/2016 ..... C25F 3/20 |

OTHER PUBLICATIONS

International Search Report, PCT Application No. PCT/JP2017/015365, dated May 16, 2017.
Kaoru Aotani, Kinzoku Hyomen Kogyo Zensho Kinsoku no Mekkki (2) Gokin Mekki, first edition, Maki Shoten, 1966, p. 176.
International Preliminary Report on Patentability, PCT Application No. PCT/JP2017/017949, dated Oct. 14, 2019.
Office Action, Korean Patent Application No. 2019-7018583, dated Oct. 21, 2020.
Non-Final Office Action, U.S. Appl. No. 16/493,539, dated Nov. 17, 2020.
Office Action, Pakistani Patent Application No. 229/2018, dated Oct. 31, 2019, 2 pages.
Office Action, Korean Patent Application No. 2019-7018582, dated Dec. 8, 2020, 10 pages.
European Supplementary Search Report, European Patent Application No. 17905121.4, dated Dec. 11, 2020, 9 pages.
U.S. Appl. No. 16/493,539, Final Office Action, dated Feb. 23, 2021, 15 pages.
European Patent Application No. 18784523.5, Extended European Search Report, dated Jan. 18, 2021, 8 pages.

* cited by examiner

Fig. 21
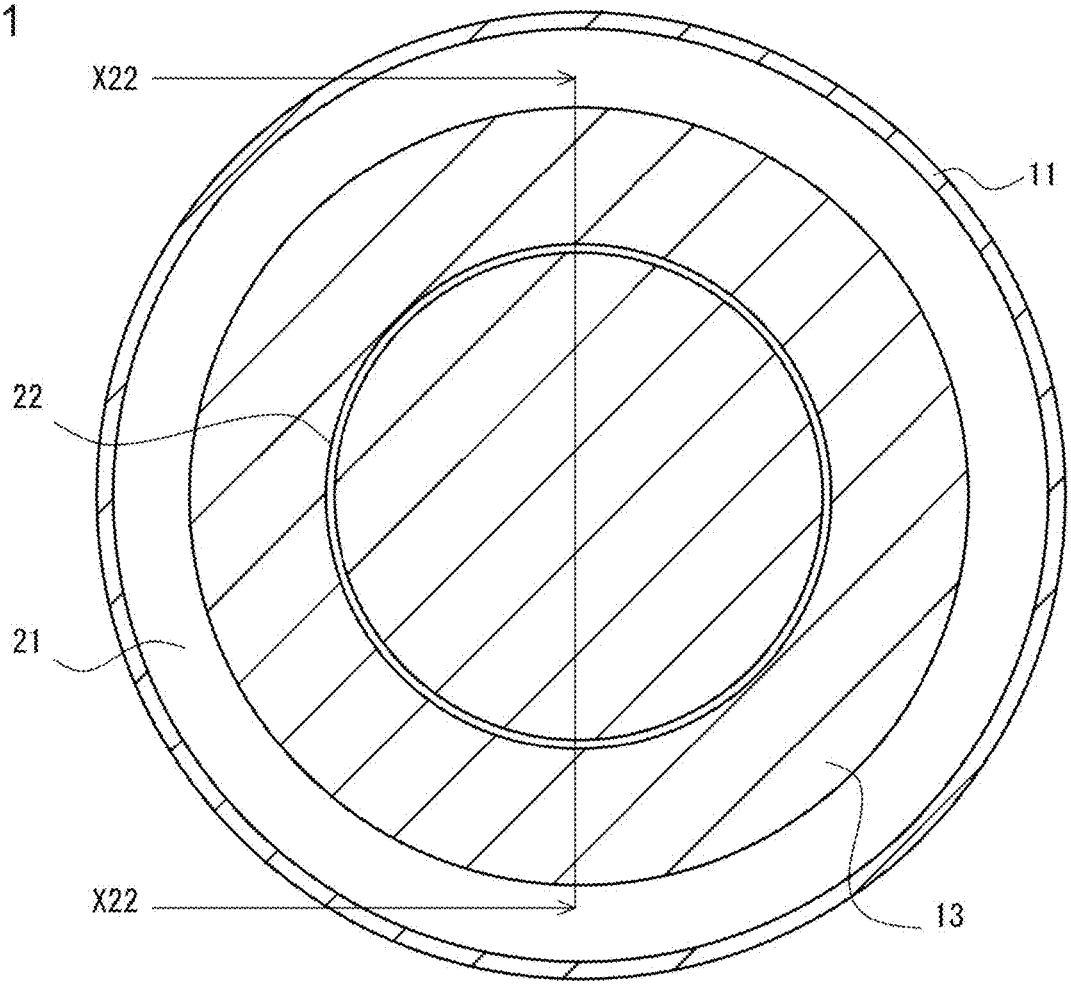
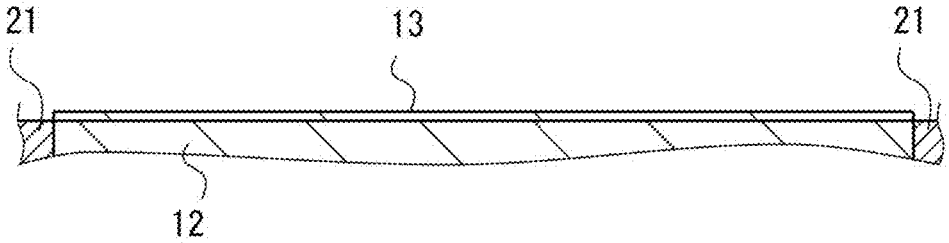
Fig. 22

ELECTROPLATING METHOD

TECHNICAL FIELD

The present disclosure is related to a method and apparatus for electroplating.

BACKGROUND ART

Patent literature 1 discloses that, as would be understood from its FIGS. 1-3, in accordance with expanding and contracting deformation of an elastic member 4 provided at a bottom of a processing tank 1, electroplated articles 6 over the elastic member 4 are agitated, and further discloses that electroplating is performed based on flow of electric current between a first electrode 7 provided on the elastic member 4 and a second electrode 12. This agitating and electroplating are simultaneously performed. The deformation of the elastic member 4 is caused by an air cylinder. FIG. 2 of the literature illustrates a receded state of a rod of the air cylinder, and FIG. 3 of the literature illustrates a frontwardly moved state of the rod. By cycling the states of FIGS. 2 and 3, the electroplated parts 6 will be agitated.

Patent literature 2 discloses at its para. 0052 that pipes 1 in a barrel 2 are smoothed by media 7 during Cu-electroplating.

Patent literature 3 discloses an apparatus for electroplating in which electroplating is performed for articles to be electroplated by using a centrifugal force that is caused by rotating an electroplating chamber. The electroplating chamber 4 has a rotator 11 provided with a cathode 10, a tubular member 3, and an anode 13 that is loosely fitted to the tubular member 3 inside of the rotator 11. The rotator 11 is driven by a powered motor 18. When the rotator 11 rotates, articles 1 inside of the rotator 11 to be electroplated are forced to be in contact with the cathode 10 in accordance with the centrifugal force. An electroplating layer will be formed on an external electrode of an article to be electroplated which faces the anode 13 in accordance with the flow of electric current between the cathode 10 and the anode 13. Its Paragraph 0038 describes that the rotator 11 will be controlled to rotate in a regular direction, to be stopped, to rotate in the reverse direction, and to be stopped in this order.

Patent literature 4 is related to an apparatus for electroplating similar to Patent literature 3. Patent literature 4 discloses that agitating media is introduced into an electroplating chamber for suppressing a condensation of conductive media and articles to be electroplated.

In terms of small metallic parts having a weight of several grams such as buttons for costumery products or sliders for slide fasteners, a barrel plating has been commonly used such as disclosed in Patent literature 5, for example.

CITATION LIST

Patent Literature

[PTL 1] Japanese Patent Application Laid-open No. 2015-63711

[PTL 2] Japanese Patent Application Laid-open No. 2013-119650

[PTL 3] Japanese Patent No. 5741944

[PTL 4] Japanese Patent No. 4725051

[PTL 5] Japanese Patent Application Laid-open No. 1-139799

SUMMARY

Technical Problem

In a barrel plating, there is a problem of insufficient cohesion between an electroplated layer and a base member due to an interface between the electroplated layer and a base member.

Solution to Problem

A method for electroplating according to an aspect of the present disclosure may include:

a step of agitating a multiple of base members that has been immersed in an electrolytic solution inside of an electroplating tank so as to flow in a circumference direction along an inner wall of the electroplating tank; and a step of electroplating the multiple of base members that is flowing along the circumference direction in the electrolytic solution inside of the electroplating tank, wherein the flow of the multiple of base members along the circumference direction may be caused by a flow of magnetic media along the circumference direction in the electrolytic solution inside of the electroplating tank or may be caused by rotation of an agitation unit provided at a bottom side of the electroplating tank, wherein at least one of the multiple of base members that is flowing along the circumference direction in the electrolytic solution inside of the electroplating tank may touch a bottom cathode provided at a bottom side of the electroplating tank, and a base member positioned upward relative to said base member touching the bottom cathode may be electrically connected to the bottom cathode via at least said base member touching the bottom cathode.

In some embodiments, the bottom cathode may extend along the circumference direction nearby the inner wall that is provided at a bottom side of a tubular portion of the electroplating tank.

In some embodiments, a top anode provided upward relative to the bottom cathode may extend along the circumference direction.

In some embodiments, the agitation unit may be provided in a rotatable manner at a bottom side of the electroplating tank and may configure at least a portion of a bottom portion of the electroplating tank.

In some embodiments, the electroplating tank may include a tubular portion, and the tubular portion is a stationary member.

In some embodiments, the magnetic media may be bar-like or needle-like members.

In some embodiments, the maximum rpm of the base members inside of the electroplating tank may be less than 40 rpm.

In some embodiments, the base member may include one or more base member-metallic elements, wherein an electroplated layer may be formed directly on the base member by the step of electroplating, the electroplated layer including at least a first electroplated layer-metallic element and a second electroplated layer-metallic element that is different from the first electroplated layer-metallic element, wherein the second electroplated layer-metallic element may be a metallic element that is identical to at least one of the one or more base member-metallic elements, and wherein a ratio of the second electroplated layer-metallic element in the electroplated layer may be continuously decreased as being away from the base member in the thickness direction of the electroplated layer and/or a clear interface does not exist between the base member and the electroplated layer.

In some embodiments, a thickness of a portion of the electroplated layer where the ratio of the second electroplated layer-metallic element is continuously decreased as being away from the base member in the thickness direction thereof may be equal to or greater than 10 nm or 20 nm or 60 nm.

In some embodiments, a thickness of a portion of the electroplated layer where the ratio of the second electroplated layer-metallic element is continuously decreased as being away from the base member in the thickness direction thereof may be equal to or less than 80 nm or 60 nm or 30 nm or 20 nm.

In some embodiments, a ratio of the first electroplated layer-metallic element at a surface of the electroplated layer may be less than 100% or 90%.

In some embodiments, a thickness of the electroplated layer may be equal to or less than 150 nm or 100 nm.

In some embodiments, the electroplated layer may have an opposite surface that is positioned opposite to the base member, and wherein decrease of the ratio of the second electroplated layer-metallic element in the electroplated layer may continue up to the opposite surface or to proximity of the opposite surface in the thickness direction of the electroplated layer.

In some embodiments, the base member may include a plurality of the base member-metallic elements, the electroplated layer may include a plurality of the second electroplated layer-metallic elements, and the respective ratios of the second electroplated layer-metallic elements in the electroplated layer may be decreased as being away from the base member in the thickness direction of the electroplated layer.

In some embodiments, a ratio of the first electroplated layer-metallic element in the electroplated layer may be decreased as being closer to the base member in the thickness direction of the electroplated layer.

In some embodiments, the base member may be metal or alloy at least including copper as the base member-metallic element.

In some embodiments, the electroplated layer may be metal or alloy at least including tin as the first electroplated layer-metallic element.

In some embodiments, the electroplated layer may have an opposite surface that is positioned opposite to the base member, and particle-like portions and/or nubby portions may be two-dimensionally densely formed in the opposite surface.

In some embodiments, an electroplated article including the base member and the electroplated layer may be at least a part of a costumery part.

An apparatus for electroplating according to some aspects of the present disclosure may include:

an electroplating tank filled with an electrolytic solution, the electroplating tank including a bottom cathode provided at a bottom side of the electroplating tank and a top anode provided upward relative to the bottom cathode;

an agitation mechanism that causes a multiple of base members that have been immersed in the electrolytic solution inside of the electroplating tank to flow in a circumference direction along an inner wall of the electroplating tank, wherein the flow of the multiple of base members along the circumference direction may be caused by a flow of magnetic media along the circumference direction in the electrolytic solution inside of the electroplating tank or may be caused by rotation of an agitation unit provided at a bottom side of the electroplating tank, and wherein at least one of the multiple of base members that is flowing along the circumference direction in the electrolytic solution inside of the electroplating tank may touch the bottom cathode, and a base member positioned upward relative to said base member touching the bottom cathode may be electrically connected to the bottom cathode via at least said base member touching the bottom cathode.

In some embodiments, the agitation mechanism may magnetically affect a multiple of magnetic media in the electrolytic solution inside of the electroplating tank to flow the multiple of magnetic media along the circumference direction, thereby causing the flow of the multiple of base members along the circumference direction.

In some embodiments, the agitation mechanism may include: an agitation unit provided in a rotatable manner at a bottom side of the electroplating tank; and a torque-supply mechanism that supplies a torque to the agitation unit.

In some embodiments, the agitation unit may include a radial array of upwardly projecting blades.

In some embodiments, the electroplating tank may include a tubular portion having an opening at its top portion which allows a throw-in or recovery of the base members, and the bottom cathode may extend along the circumference direction nearby the inner wall at a bottom side of the tubular portion.

In some embodiments, the tubular portion may be a stationary member.

In some embodiments, the maximum rpm of the base members inside of the electroplating tank may be less than 40 rpm.

An apparatus for electroplating according to some aspects of the present disclosure is any one of the above-described apparatuses for electroplating in which the base member includes one or more base member-metallic elements, wherein an electroplated layer may be formed directly on the base member which includes at least a first electroplated layer-metallic element and a second electroplated layer-metallic element that is different from the first electroplated layer-metallic element, wherein the second electroplated layer-metallic element may be a metallic element that is identical to at least one of the one or more base member-metallic elements, and wherein a ratio of the second electroplated layer-metallic element in the electroplated layer may be continuously decreased as being away from the base member in the thickness direction of the electroplated layer and/or a clear interface does not exist between the base member and the electroplated layer.

Advantageous Effects of Invention

According to an aspect of the present disclosure, it may be possible to provide electroplated articles with improved cohesion between electroplated layer and base member.

BRIEF DESCRIPTION OF DRAWINGS

FIG. 21 is a schematic top view of an electroplating tank of an apparatus for electroplating according to an aspect of the present disclosure, showing an exemplary arrangement of cathode and anode in an electroplating tank and also showing a low-friction member provided on a bottom portion of an electroplating tank.

FIG. 22 is a schematic partial sectional view of an apparatus for electroplating along X22-X22 in FIG. 21.

DESCRIPTION OF EMBODIMENTS

Hereinafter, non-limiting exemplary embodiments of the present invention will be described with references to FIGS. 1 to 29. One or more disclosed exemplary embodiments and respective features included in the exemplary embodiment are not mutually exclusive. A skilled person would properly combine the respective exemplary embodiments and/or respective features without requiring excess descriptions. A skilled person would also understand synergic effect by such combination. Overlapping descriptions among exemplary embodiments will be basically omitted. Referenced drawings are mainly for the purpose of illustrating an invention and may possibly be simplified for the sake of convenience of illustration.

A plurality of features described below in relation to an electroplated article and/or a method of manufacturing electroplated articles, and a method of electroplating and/or an apparatus for electroplating may be understood as, additionally to a combination of features, an individual feature which is independent to other features. The individual feature may be understood as independent individual feature without requiring a combination with other features, but it could be understood as a combination with one or more other individual features. Describing all possible combinations of individual features will be clearly lengthy for a skilled person in the art, and thus omitted. The individual features may be indicated by expressions such as "In some embodiments", "In some cases", and "In some examples". The individual features will be understood as universal features which are not only effective to an electroplated article and/or a method of manufacturing electroplated articles, and a method of electroplating and/or an apparatus for electroplating illustrated in figures for example, but also effective to other various electroplated articles and/or methods of manufacturing electroplated articles, and other various methods of electroplating and/or apparatuses for electroplating.

The terms such as "first", "second", and "third" will be affixed in an effort to logically distinguish nouns to which they are affixed. For example, "first" will not be used to indicate that "only one" noun to which "first" is affixed exists (unless otherwise clearly indicated). For example, descriptions such as "a plurality of second electroplated layer-metallic elements" will suggest existence of plural metallic elements as a second electroplated layer-metallic element. The terms such as "first", "second", and "third" will not be used to indicate that nouns to which they are affixed are different each other (unless otherwise clearly indicated). For example, as would be understood from a description of "a third metallic element is a metallic element that is identical to at least one of one or more first metallic elements", the third metallic element can be identical to the first metallic element.

Figure 1:
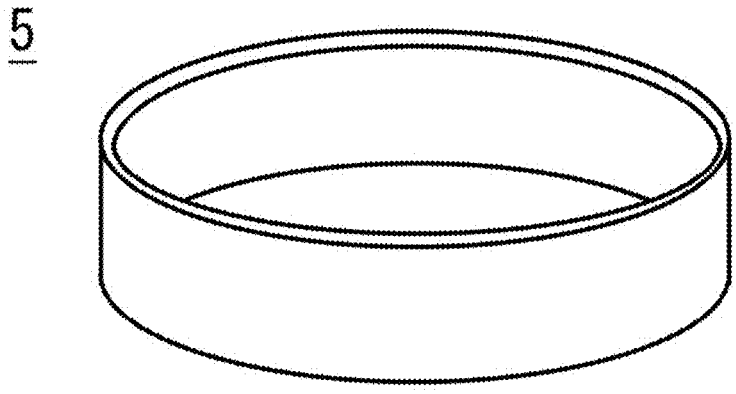
FIG. 1 is a schematic perspective view of a cap of an electroplated article according to an aspect of the present disclosure.

FIG. 1 is a schematic perspective view of a cap of an electroplated article 5.

Figure 2:
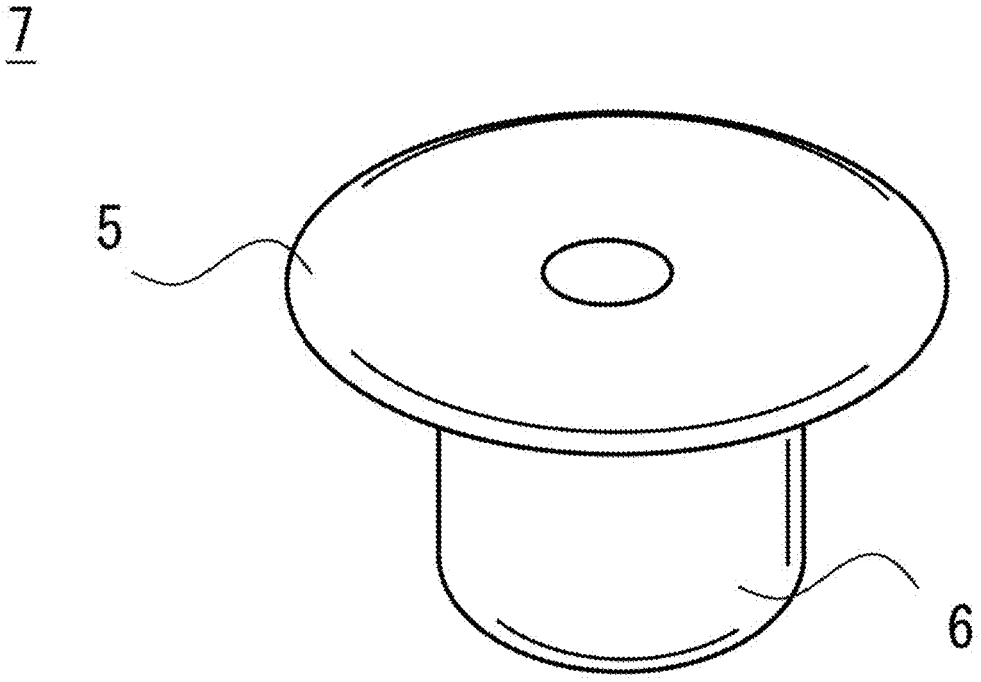
FIG. 2 is a schematic perspective view of a costumery part in which a cap as an electroplated article according to an aspect of the present disclosure has been attached to a core part.
Figure 3:
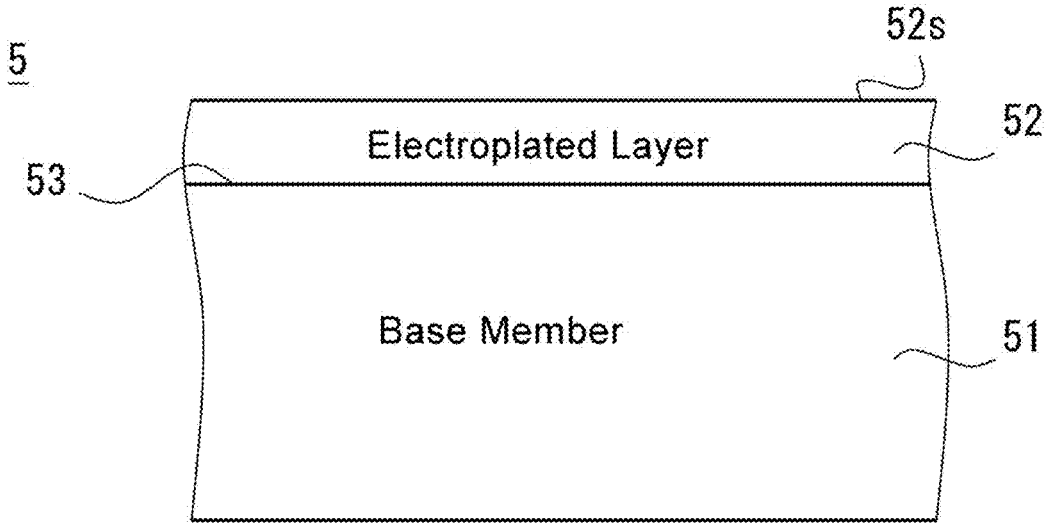
FIG. 3 is a view schematically illustrating a layer structure of an electroplated article according to an aspect of the present disclosure, illustrating a base member and an electroplated layer that is formed directly on the base member.
Figure 4:
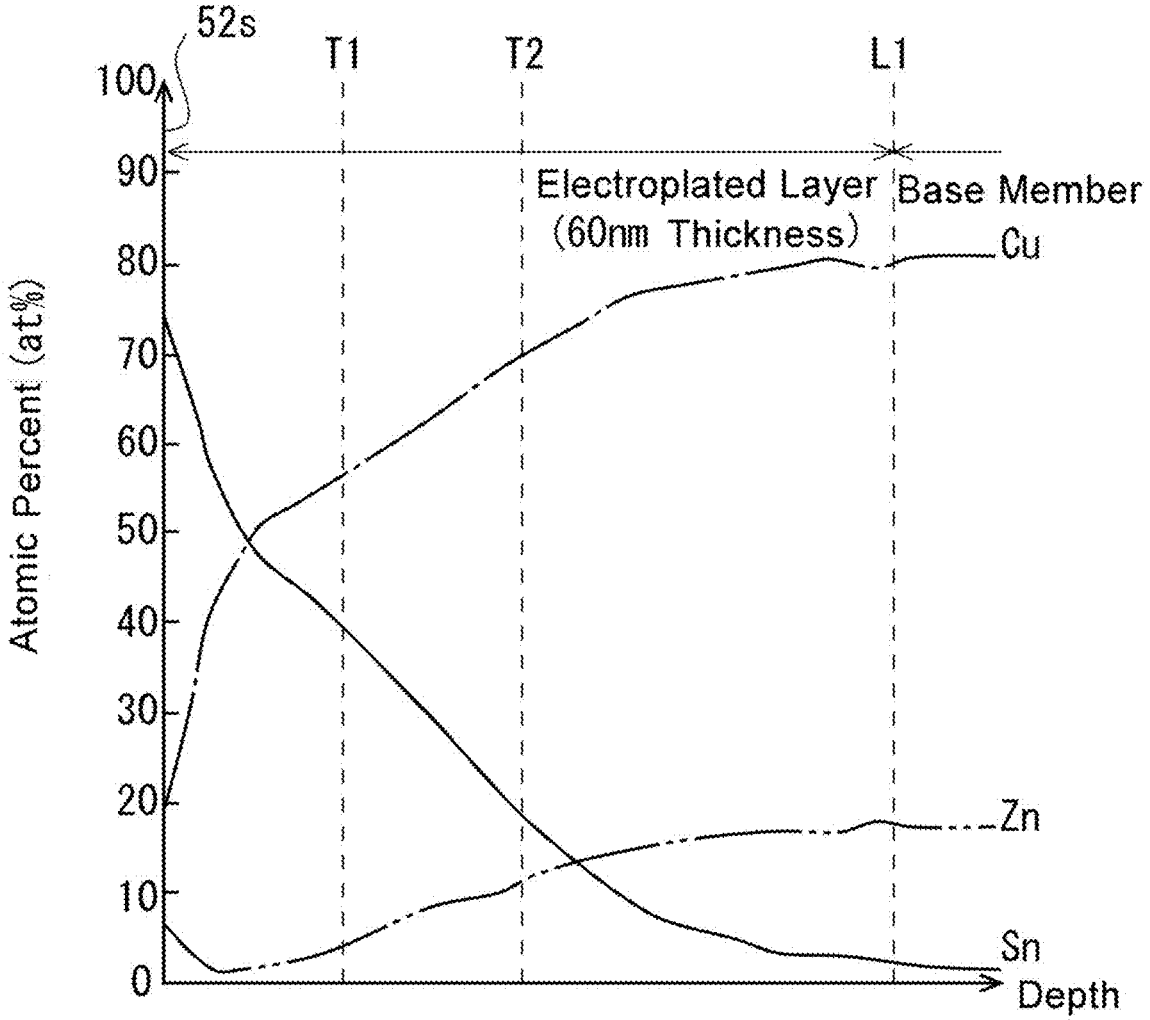
FIG. 4 is a schematic graph illustrating a change of ratio of respective metallic elements of an electroplated article in the thickness direction of an electroplated layer according to an aspect of the present disclosure. A ratio of a second electroplated layer-metallic element (Cu, Zn) in the electroplated layer is continuously decreased as being away from the base member in the thickness direction of the electroplated layer. A ratio of a first electroplated layer-metallic element (Sn) is decreased as being closer to the base member in the thickness direction of the electroplated layer.
Figure 5:
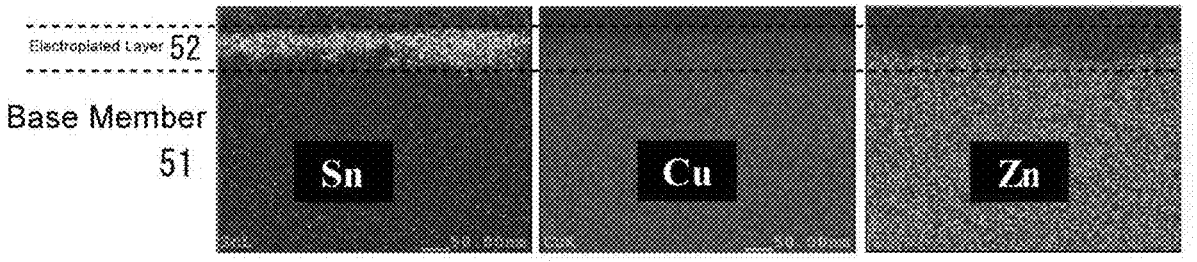
FIG. 5 is a view showing an elemental distribution in a cross-section of an electroplated article according to an aspect of the present disclosure, showing that: a first electroplated layer-metallic element (Sn) exists in the electroplated layer; a base member-metallic element (Cu) exists in the base member and the electroplated layer; and a base member-metallic element (Zn) exists in the base member and the electroplated layer. This shows that Cu exists much closer to a surface of the electroplated layer than Zn.
Figure 6:
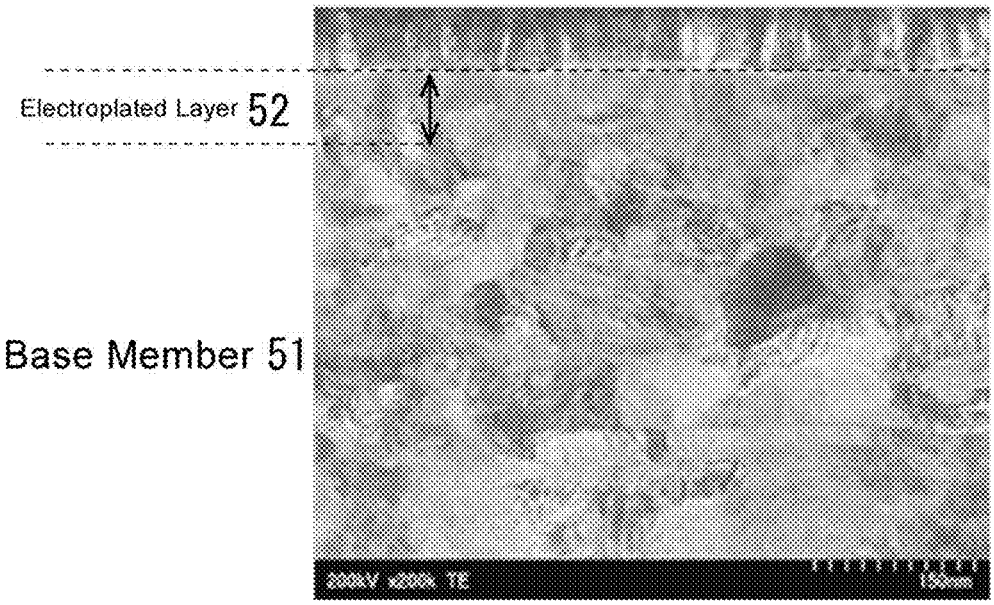
FIG. 6 is a TEM image of a cross-section of an electroplated article according to an aspect of the present disclosure, showing that a clear interface does not exist between the base member and the electroplated layer.
Figure 7:
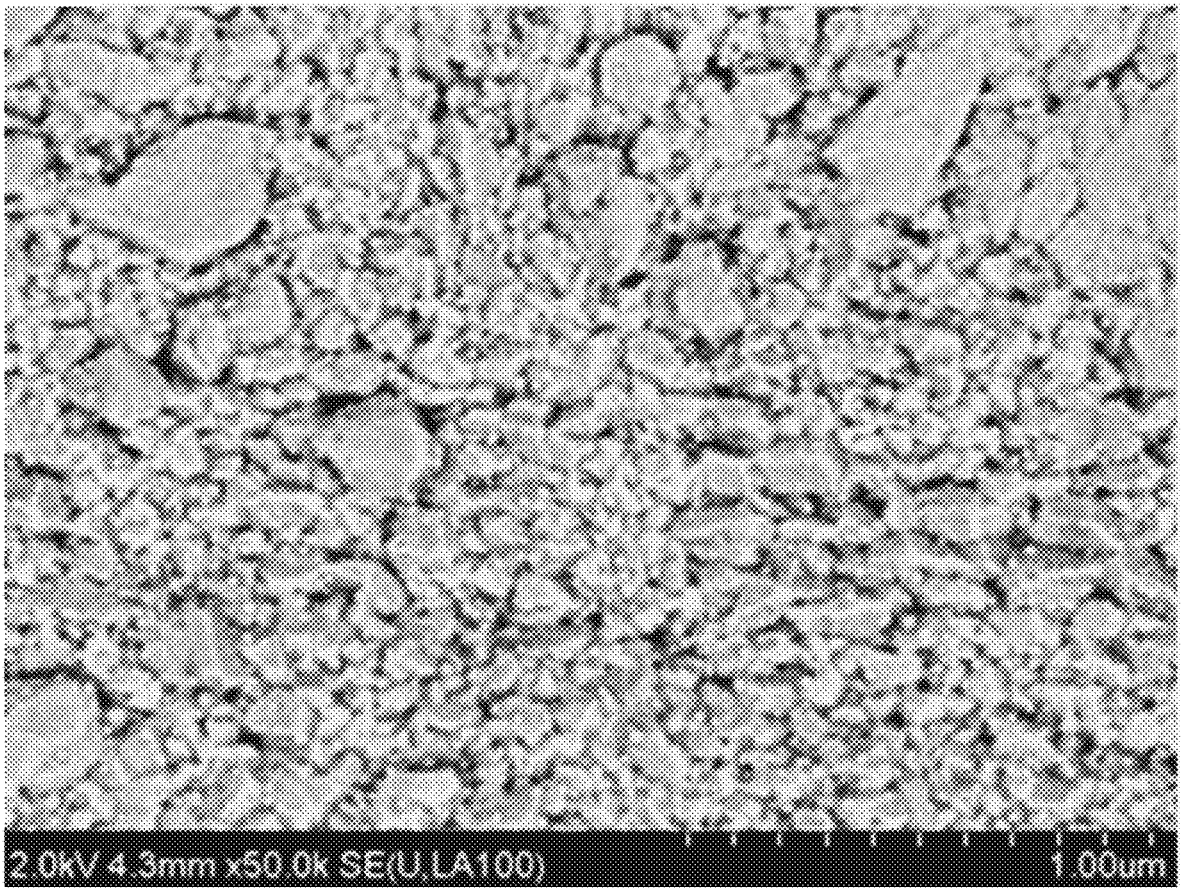
FIG. 7 is a SEM image showing a surface condition of an electroplated layer according to an aspect of the present disclosure, showing that particle-like portions and/or nubby portions are formed two-dimensionally densely.

FIG. 2 is a schematic perspective view of a costumery part 7 in which a cap as an electroplated article 5 has been attached to a core part 6. FIG. 3 is a view schematically illustrating a layer structure of an electroplated article 5, illustrating a base member 51 and an electroplated layer 52 that is formed directly on the base member 51. It should be noted that an interface 53 between a base member 51 and an electroplated layer 52 is illustrated by a solid line, but a clear interface does not exist actually. The base member 51 includes one or more base member-metallic elements. The electroplated layer 52 includes one or more first electroplated layer-metallic elements. The electroplated layer 52 includes a base member-metallic element additionally to the first electroplated layer-metallic element. FIG. 4 is a schematic graph illustrating a change of ratio of respective metallic elements in an electroplated article 5 in the thickness direction of an electroplated layer 52. A ratio of a second electroplated layer 52-metallic element (Cu, Zn) in the electroplated layer 52 is continuously decreased as being away from the base member 51 in the thickness direction of the electroplated layer 52. A ratio of a first electroplated layer-metallic element (Sn) is decreased as being closer to the base member 51 in the thickness direction of the electroplated layer 52. FIG. 5 is a view showing an elemental distribution in a cross-section of an electroplated article 5, showing that: a first electroplated layer-metallic element (Sn) exists in the electroplated layer 52; a base member-metallic element (Cu) exists in the base member 51 and electroplated layer 52; and a base member-metallic element (Zn) exists in the base member 51 and the electroplated layer 52. This shows that Cu exists much closer to a surface of the electroplated layer 52 than Zn. FIG. 6 is a TEM image of a cross-section of an electroplated article 5 according to an aspect of the present disclosure, showing that a clear interface does not exist between the base member 51 and the electroplated layer 52. FIG. 7 is a SEM image showing a surface condition of an electroplated layer 52, showing that particle-like portions and/or nubby portions are formed two-dimensionally densely.

In some embodiments, the electroplated article 5 includes a base member 51, and electroplated layer 52 that is formed directly on the base member 51. The electroplated article 5 may be an article in which the base member 51 is covered at least by the electroplated layer 52. The electroplated article 5 may be at least a part of a costumery part 7, not necessarily limited to through. In some cases of exemplary FIGS. 1 and 2, the electroplated article 5 is a part of a costumery part 7 and is combined with another part to construct the costumery part 7. The electroplated article 5 of some cases of exemplary FIGS. 1 and 3 has a cup-shaped base member 51 that is a cap, and an electroplated layer 52 that is formed on a surface of the base member 51 or covers an entire surface of the base member 51. In the case illustrated in FIG. 2, the electroplated article 5 of FIG. 1 is attached to a core part 6 so that a costumery part 7 is configured. Note that, in a technical field of costumery parts, there is a strong demand to have a wide variety of metallic colors or metallic lusters of costumery parts while suppressing a material and/or production cost.

In some cases of exemplary FIGS. 3 and 4, the base member 51 includes one or more base member-metallic elements. The electroplated layer 52 includes at least a first electroplated layer-metallic element and a second electroplated layer-metallic element that is different from the first electroplated layer-metallic element. In a case where the base member 51 is made of pure metal, the base member 51 includes one base member-metallic element. In a case where the base member 51 is made of alloy, the base member 51 includes two or more base member-metallic elements. There are cases where a trace amount of incidental impurities or incidental metals are included during a process of manufacturing or refining of metal products of a pure metal or alloy etc. For example, in a case where a base member 51 is made of brass (CuZn), a trace amount of another metal or alloy could be included in the base member 51. For example, a trace amount of metal other than Sn could be included in a Sn-electrode for electroplating. It should be noted that both of the base member-metallic element and the electroplated layer-metallic element described in the present specification should not be construed to indicate the incidental metal. It should be noted that the base member-metallic element can be any one of various metallic elements. The first and second electroplated layer-metallic elements or other electroplated layer-metallic elements can be any one of various metallic elements.

In some cases, as would be understood from FIGS. 3 and 4, the second electroplated layer-metallic element included in the electroplated layer 52 is a metallic element that is identical to at least one of the one or more base member-metallic elements. In an example of FIG. 4, the first electroplated layer-metallic element is Sn, and the second electroplated layer-metallic element is Cu and/or Zn. The first electroplated layer-metallic element (Sn in the example of FIG. 4) is different from at least one base member-metallic element (both of Cu and Zn in the example of FIG. 4). In some cases, the first electroplated layer-metallic element included in the electroplated layer 52 is different from at least one of a plurality of base member-metallic elements (This would be well understood by referring to FIG. 11 and so on).

As would be well understood from the non-limiting exemplary demonstration of FIGS. 4 and 5, in some cases, a ratio of the second electroplated layer-metallic element (Cu and Zn in the example of FIG. 4) in the electroplated layer 52 is continuously decreased as being away from the base member 51 in the thickness direction of the electroplated layer 52. Additionally or alternatively, as would be well understood from the non-limiting exemplary demonstration of FIG. 6, a clear interface does not exist between the base member 51 and the electroplated layer 52. In such a case, cohesion between the base member 51 and the electroplated layer 52 may be enhanced. Due to this improved cohesion, a likelihood of interface separation between the base member 51 and the electroplated layer 52 may be reduced and/or thinning of the electroplated layer 52 may be facilitated, for example. It should be noted that the first electroplated layer-metallic element is originated from a metal ion existed in an electrolytic solution during an electroplating, not necessarily limited to through. The second electroplated layer-metallic element is originated from a base member-metallic element of the base member 51.

As would be understood from the whole disclosure of the present specification, if necessary, the electroplated layer can be defined as a layer including a metal deposited on the base member by electroplating in its thickness direction. Therefore, in the present specification, the electroplated layer can include a metal other than a metal deposited on the base member by electroplating. The above-described electroplated layer-metallic element is a metallic element configuring the electroplated layer, a metallic element included in the electroplated layer in other words. The second electroplated layer-metallic element may be originated from a composition of the base member. On the other hand, the first electroplated layer-metallic element is not needed to be originated from a composition of the base member. In particular, without an intention of narrowing, the first electroplated layer-metallic element may be a metallic element deposited on the base member as at least a portion of the electroplated layer. For example, the first electroplated layer-metallic element is equal to a metallic element of deposited metallic ions which had been supplied to an electroplating solution separately to the base member and had been moved to the base member through electroplating. The second electroplated layer-metallic element is not limited to a deposit onto the base member differently from the first electroplated layer-metallic element. The second electroplated layer-metallic element may be a base member-metallic element which had existed or been included in the base member to be electroplated and/or a base member-metallic element which has eluted from and deposited onto the base member to be electroplated. The base member-metallic element may be a metallic element which configures the base member, a metallic element included in the base member in other words.

As would be understood from non-limiting exemplary demonstration of FIGS. 4 and 5, in some cases, a ratio of metallic element at a surface of the electroplated layer can be easily changed by the change in the thickness of the electroplated layer. For example, a ratio of metallic element at a surface of the electroplated layer of FIG. 4 having a thickness T1 and a ratio of metallic element at a surface of the electroplated layer of FIG. 4 having a thickness T2 are different. The configuration of electroplated layer can be changed by changing the thickness of the electroplated layer, and thus a variation of electroplated layers can be easily obtained. The variation of electroplated layer can be a variation of chemical property, electrical property and/or physical property in accordance with a ratio of element. The variation of the electroplated layer can be a variation of color of the electroplated layer. In some cases, a variation of metallic colors or metallic lusters of costumery parts can be easily ensured. It should be noted that an interface L1 is illustrated between the electroplated layer and the base member in FIG. 4. In FIG. 4, the first electroplated layer-metallic element (Sn) does not exactly reach to a zero in a region of the base member deeper than the interface L1. However, this is due to errors caused during a measurement and a data output. As would be understood from the elemental distribution in FIG. 5, the first electroplated layer-metallic element (Sn) does not exist in a region of the base member 51.

As would be understood from the non-limiting exemplary demonstration of FIGS. 4 and 5, in some cases, a ratio of first electroplated layer-metallic element (Sn) is decreased as being closer to the base member 51 in the thickness direction of the electroplated layer 52. As would be understood from the non-limiting exemplary demonstration of FIG. 4, in some cases, a curved line showing a change of a ratio of the first electroplated layer-metallic element in the thickness direction of the electroplated layer 52 and a curved line showing a change of a ratio of the base member-metallic element in the thickness direction of the electroplated layer 52 are crossed. In other words, a greater amount of the first electroplated layer-metallic element exists nearby the opposite surface 52*s* of the electroplated layer 52 opposite to the side of the base member 51, and a greater amount of the second electroplated layer-metallic element exists in a region of the electroplated layer 52 nearby the base member 51. In the present specification, the opposite surface 52*s* of the electroplated layer 52 is also referred to as a surface of the electroplated layer 52.

As would be understood from the non-limiting exemplary demonstration of FIG. 4, in some cases, decrease of the ratio of the second electroplated layer-metallic element in the electroplated layer 52 continues up to the opposite surface 52*s* or to proximity of the opposite surface 52*s* in the thickness direction of the electroplated layer 52. In other words, in some embodiments, the electroplated layer 52 is not formed to be thicker such that a change of a ratio of base member-metallic element ceases. Thinning of the electroplated layer 52 would contribute in reducing an amount of metal material used for forming the electroplated layer.

As would be understood from the non-limiting exemplary demonstration of FIG. 4, in some cases, the base member 51 includes a plurality of base member-metallic elements, the electroplated layer 52 includes a plurality of base member-metallic elements, and the respective ratios of the second electroplated layer-metallic elements in the electroplated layer 52 are decreased as being away from the base member 51 in the thickness direction of the electroplated layer 52. A case is envisage where the base member 51 includes three or more base member-metallic elements. A case is envisage where the electroplated layer 52 includes two or three or more electroplated layer-metallic elements.

It should be noted that a ratio of an element should be based on an atomic percent (at %). That is, when a ratio of an element is great, then a value of atomic percent of that element is great. The determination of atomic percent should be done by using an Auger electron spectroscopy analyzer of JAMP9500F produced by JEOL Ltd.

The base member-metallic element and the first electroplated layer-metallic element can be any one of various metallic elements and, as an example, the base member 51 is made of brass (CuZn) and the base member-metallic elements are copper (Cu) and zinc (Zn). In some cases, the base member 51 is a metal or an alloy at least including copper as a base member-metallic element. In some cases, the electroplated layer 52 is a metal or alloy at least including tin (Sn) as a first electroplated layer-metallic element. In some cases of exemplary FIG. 4 and so on, the base member 51 includes a plurality of base member-metallic elements (for example, Cu and Sn), and the electroplated layer 52 includes a plurality of second electroplated layer-metallic elements (for example, Cu and Sn). The respective ratios of the second electroplated layer-metallic elements (for example, Cu and Sn) in the electroplated layer 52 are decreased as being away from the base member 51 in the thickness direction of the electroplated layer 52.

As would be understood from the non-limiting exemplary demonstration of FIG. 7, in some cases, particle-like portions and/or nubby portions are two-dimensionally densely formed in the opposite surface 52*s* of the electroplated layer 52. The electroplated layer 52 may have an improved tolerance to alkali and acid chemicals due to its fine surface condition. Even if the electroplated layer 52 is formed to be thin, a sufficient chemical tolerance of the electroplated layer 52 may be ensured. In some cases, the thickness of the electroplated layer 52 is equal to or less than 150 nm or 100 nm. Note that, for electroplated articles according to some embodiments, there is no particular problem in terms of cohesion of electroplated layer even if the thickness of the electroplated layer 52 is equal to or less than 150 nm or 100 nm. Therefore, the thickness may be set to be minimum when a production efficiency of electroplated articles is pursued. From this perspective, 150 nm or less or 100 nm or less may be preferable but not necessarily limited thereto, and the time period of electroplating can be longer to increase the thickness of the layer.

As described above, in some cases, a clear interface does not exist between the base member 51 and the electroplated layer 52. It is assumed that moderate change of ratio of the first and/or second electroplated layer-metallic elements in the electroplated layer 52 results in the non-existence of interface. In order to determine the thickness of the electroplated layer 52, we have to identify an interface between the base member 51 and the electroplated layer 52. In the present specification, an interface between the base member 51 and the electroplated layer 52 is determined based on a measurements shown in FIG. 4 and/or FIG. 5. In a method of measurement of FIG. 4, an interface between the base member 51 and the electroplated layer 52 is defined by a depth from a surface of the electroplated layer 52 at which a predetermined ratio of base member-metallic element is attained in the base member 51. In a method of measurement of FIG. 5, an interface between the base member 51 and the electroplated layer 52 is defined by a distribution of the first electroplated layer-metallic element and/or a distribution of the base member-metallic element. For example, in a case where brass having an elemental ratio of Cu:Zn=80:20 is used for the base member 51, an interface may be defined at a position at which an atomic percent of Cu reaches about 80 at % and an atomic percent of Zn reaches about 20 at %. However, the change of ratio of atomic percent shown in FIG. 4 naturally includes an error because it is observed by elemental analysis of material released by etching in a measurement device. The interface between the base member 51 and the electroplated layer 52 should be determined appropriately in light of such an error in measurement.

For articles which embody the present invention, an interface between the base member 51 and the electroplated layer 52 should be determined as follows. A position at which an atomic percent of the major base member-metallic element reaches at 98% of the maximum ratio of the major base member-metallic element in the base member 51 should be determined as an interface between the base member 51 and the electroplated layer 52. In a case where the base member 51 includes a single base member-metallic element, the major base member-metallic element in the base member 51 is that single base member-metallic element. In a case where the base member 51 includes a plurality of base member-metallic elements, the major base member-metallic element in the base member 51 is a base member-metallic element having the maximum ratio, i.e. atomic percent. For example, in a case where brass having an elemental ratio of Cu:Zn=80:20 is used for the base member 51, a position at which an atomic percent of Cu having the maximum ratio of metallic ingredient (the maximum atomic percent of metallic ingredient) reaches 98% of the maximum ratio of 80 at %.

There is a clear interface for cases of conventional barrel plating or rack plating unlike articles having a condition of non-interface according to the present invention, and thus the position of that interface is defined as an interface between the base member 51 and the electroplated layer 52. Actually, there are minute projections and recesses in a surface of a base metal, and thus the position of averaged height (Rc) of the projections and recesses at that surface will be defined as an interface between the base member 51 and the electroplated layer 52.

Figure 8:
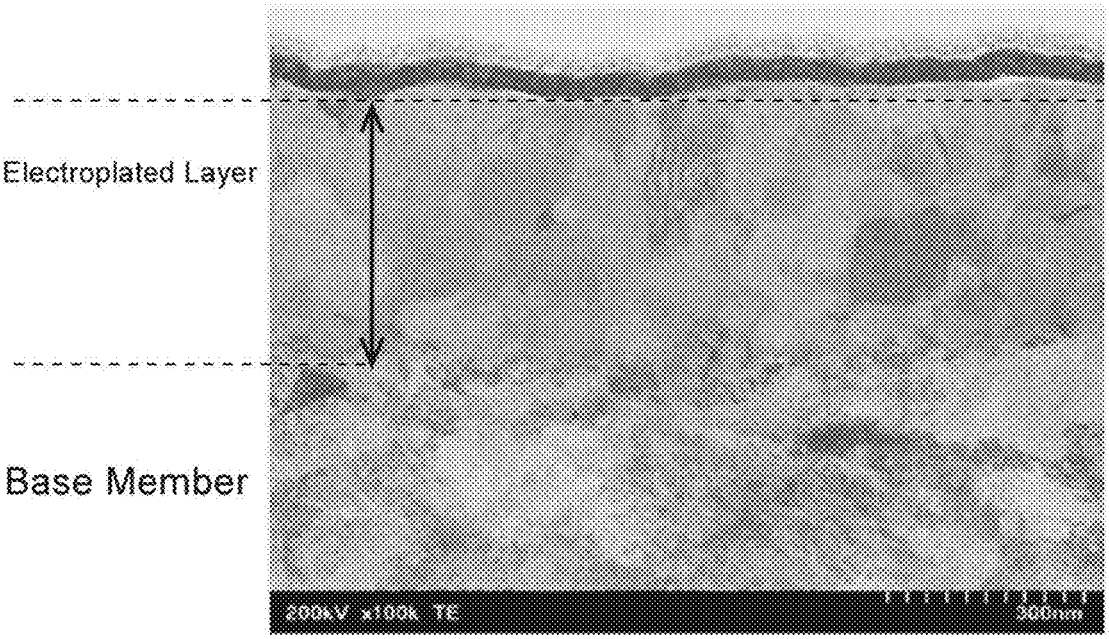
FIG. 8 is a TEM image of a cross-section of a conventional electroplated article, showing that a clear interface exists between the base member and the electroplated layer.
Figure 9:
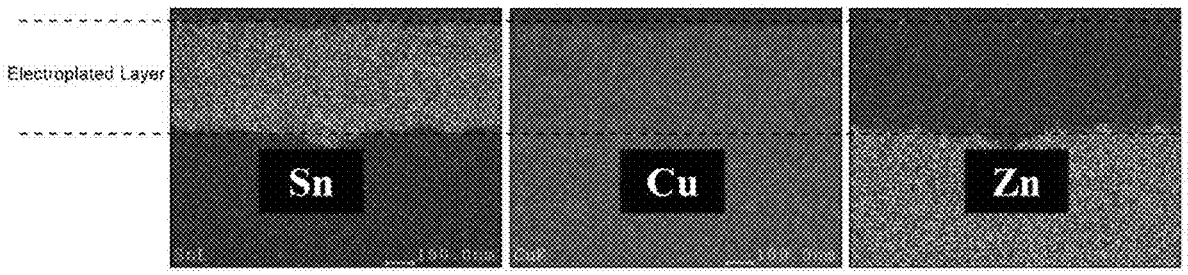
FIG. 9 is a view showing an elemental distribution in a cross-section of a conventional electroplated article, showing that: an electroplated layer-metallic element (Sn) exists in an electroplated layer; an electroplated layer-metallic element and a base member-metallic element (Cu) exist in the base member and the electroplated layer; and a base member-metallic element (Zn) exists in the base member. This shows that a base member-metallic element (Zn) does not exist in the electroplated layer.
Figure 10:
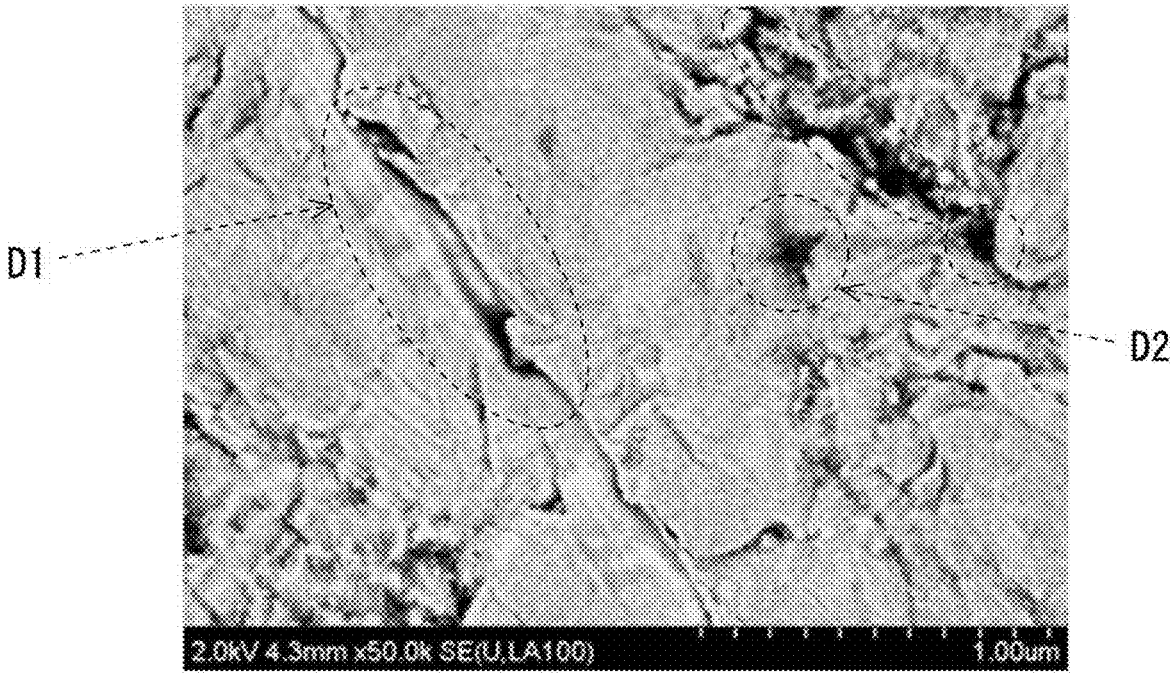
FIG. 10 is a SEM image showing a surface condition of an electroplated layer of a conventional electroplated article, showing that cracks and pin-holes are formed.

As described above, in some cases, the ratio of the second electroplated layer-metallic element in the electroplated layer 52 moderately changes and/or a clear interface does not exist between the base member 51 and the electroplated layer 52. With reference to FIGS. 8-10, description will be followed for conventional electroplated articles that do not have such electroplated layer 52. FIG. 8 is a TEM image of a cross-section of a conventional electroplated article, showing that an interface exists between the base member and the electroplated layer. FIG. 9 is a view showing an elemental distribution in a cross-section of a conventional electroplated article, showing that: an electroplated layer-metallic element (Sn) exists in an electroplated layer; an electroplated layer-metallic element and a base member-metallic element (Cu) exist in the base member and the electroplated layer; and a base member-metallic element (Zn) exists in the base member. This shows that a base member-metallic element (Zn) does not exist in the electroplated layer. As shown in FIGS. 8-9, in the conventional barrel plating, there is a case where a layer thickness is set to be greater than 200 nm for improving a color tone or surface condition of an electroplated surface, and furthermore the electroplated layer is simply laminated onto the base metal. Therefore, an interface between the base member 51 and the electroplated layer 52 is clearly identifiable visually. Note that there are minute projections and recesses in a surface of base metal in actual, and thus the interface may be a surface of the projections and recesses. In a case where the thickness of the electroplated layer is expressed by a numerical value, a position of averaged height (Rc) of projections and recesses in that surface is determined as an interface between the base member 51 and the electroplated layer 52 just for convenience. FIG. 10 is a SEM image showing a surface condition of an electroplated layer of a conventional electroplated article, showing that cracks and pin-holes are formed.

In FIGS. 8-10, the base member is made of brass (CuZn), the electroplated layer is made of CuSn alloy. In an electroplated layer of CuSn layer having 250 nm thickness, an elemental percent of Cu and an elemental percent of Sn are substantially the same. As shown in FIG. 8, a clear interface exists between the electroplated layer and the base member as would be understood from a difference in metallic structures of the electroplated layer and the base member. As shown in FIG. 9, the electroplated layer does not include Zn of base member-metallic element. The reason why the electroplated layer includes Cu is that Cu is an electroplated layer-metallic element. As shown in FIG. 10, there are cracks D1 and pin-holes D2 in a surface of the electroplated layer. If alkali or acid chemical enters into the cracks D1 and pin-holes D2, then rust or collapse of the electroplated layer may progress. In order to fully cope with this and/or other technical problems, a thickness of electroplated layer may be required to be equal to or greater than about 10000 nm. For electroplated articles based on a conventional realistic mass-production level, the thickness of the electroplated layer is set to be over a range of 100 nm to 200 nm such as set to be 250 nm for example, and thus technical problems such as peeling-off of electroplated layer or oxidization or color change are compromised to some extents sufficient for practical use.

The electroplated layer of the conventional electroplated article of FIGS. 8-10 is formed by a barrel plating. A barrel plating is a method where articles to be electroplated, i.e. base members in the present specification are supplied into a barrel (rotational cago) immersed in an electroplating bath and electroplating is performed while the barrel is being rotated. The benefit is that a large number of articles can be electroplated at once. The electroplated layer of electroplated article according to an embodiment of FIGS. 1-7 is formed by a non-limiting exemplary method described below with reference to FIGS. 19-28, but not necessarily limited to this method. A skilled person in the art may improve the existing barrel plating or invent completely different method for achieving the electroplated layer according to the present disclosure.

The electroplated article according to an exemplary embodiment of FIGS. 1-7 may be able to solve one or more problems of conventional electroplated article of FIGS. 8-10. That is, the electroplated article according to an exemplary embodiment of FIGS. 1-7 may contribute in solving conventional problem of low cohesion due to an interface between the base member and the electroplated layer. When an interface exists between the electroplated layer and the base member, even if the electroplated layer was formed to be thicker, peeling-off of the electroplated layer might be still induced. Additionally or alternatively, the electroplated article according to an exemplary embodiment of FIGS. 1-7 may contribute in solving conventional problem of thick electroplated layer. Additionally or alternatively, the electroplated article according to an exemplary embodiment of FIGS. 1-7 may contribute in solving conventional problem that plural cracks and/or pin-holes are formed in a surface of the electroplated layer.

Figure 11:
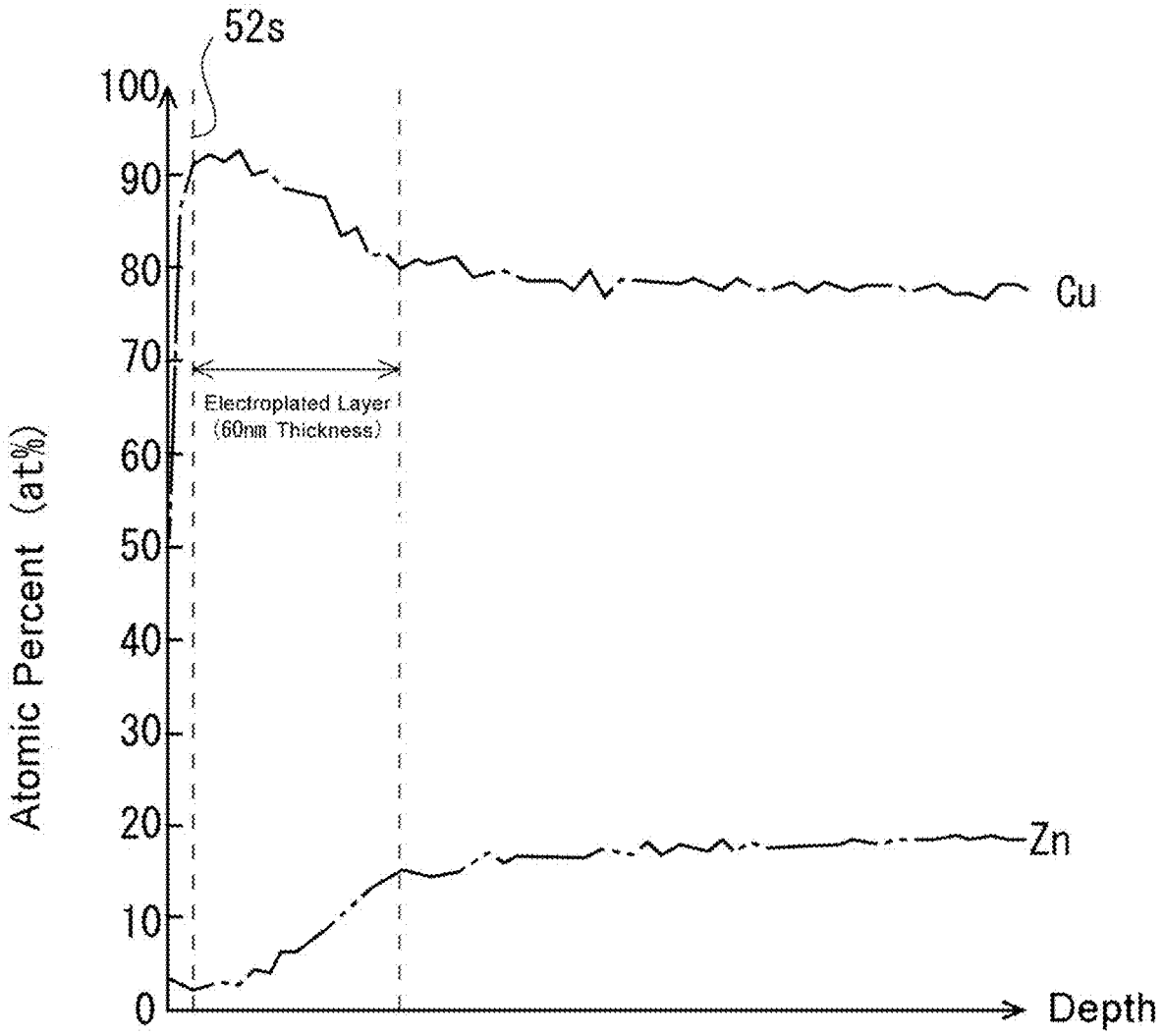
FIG. 11 is a schematic graph illustrating a change of ratio of respective metallic elements of an electroplated article in the thickness direction of an electroplated layer according to an aspect of the present disclosure. A ratio of a second electroplated layer-metallic element (Zn) in the electroplated layer is continuously decreased as being away from the base member in the thickness direction of the electroplated layer. A ratio of a first electroplated layer-metallic element (Cu) is decreased as being closer to the base member in the thickness direction of the electroplated layer.

Hereinafter, variations of metallic element will be mainly discussed with reference to FIGS. 11-18. FIG. 11 is a schematic graph illustrating a change of ratio of respective metallic elements of an electroplated article in the thickness direction of an electroplated layer. In FIG. 11, the base member 51 is made of brass (CuZn), and the first electroplated layer-metallic element is copper (Cu). As would be understood from FIG. 11, a ratio of a second electroplated layer-metallic element (Zn) in the electroplated layer is continuously decreased as being away from the base member in the thickness direction of the electroplated layer. In the case of FIG. 11, a change in ratio of the metallic element (Cu), originated from the base member 51, in the electroplated layer cannot be observed because the first electroplated layer-metallic element is copper (Cu).

A ratio of the metallic element (Cu) is decreased as being closer to the base member in the thickness direction of the electroplated layer. The change of ratio of the metallic element (Cu) in the electroplated layer of FIG. 11 represents the total change in ratio of Cu as the base member-metallic element and of Cu as the first electroplated layer-metallic element. However, it is apparent that greater amount of first electroplated layer-metallic element exists at a side of surface of the electroplated layer 52. Thus, the change of ratio of the metallic element (Cu) in the electroplated layer of FIG. 11 proves that a ratio of the first electroplated layer-metallic element (Cu) is decreased as being closer to the base member in the thickness direction of the electroplated layer.

Figure 12:
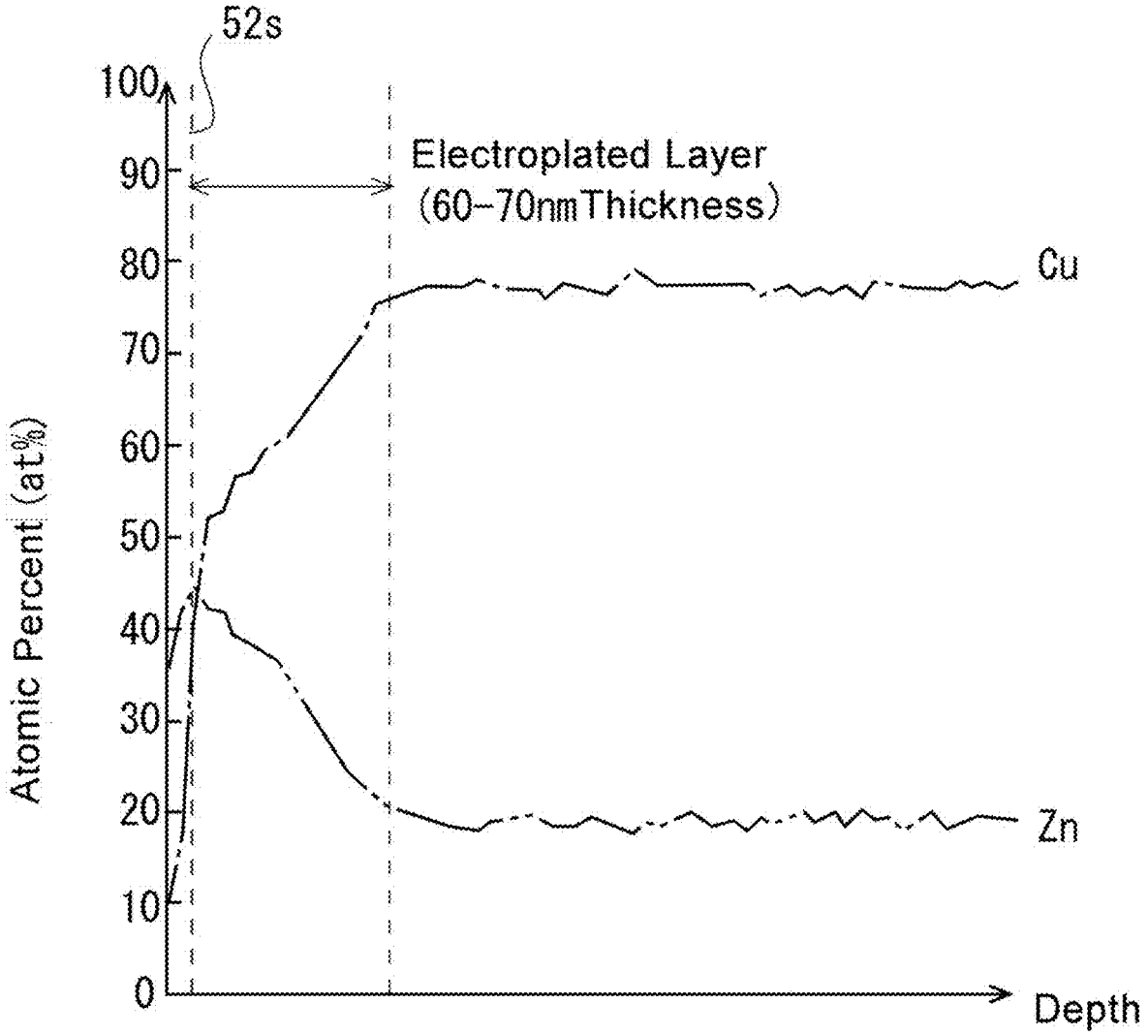
FIG. 12 is a schematic graph illustrating a change of ratio of respective metallic elements of an electroplated article in the thickness direction of an electroplated layer according to an aspect of the present disclosure. A ratio of a second electroplated layer-metallic element (Cu) in the electroplated layer is continuously decreased as being away from the base member in the thickness direction of the electroplated layer. A ratio of a first electroplated layer-metallic element (Zn) is decreased as being closer to the base member in the thickness direction of the electroplated layer.

FIG. 12 is a schematic graph illustrating a change of ratio of respective metallic elements of an electroplated article in the thickness direction of an electroplated layer. In FIG. 12, the base member 51 is made of brass (CuZn), and the first electroplated layer-metallic element is zinc (Zn). As would be understood from FIG. 12, a ratio of a second electroplated layer-metallic element (Cu) in the electroplated layer is continuously decreased as being away from the base member in the thickness direction of the electroplated layer. In a case of FIG. 12, the first electroplated layer-metallic element is zinc (Zn), and thus it is not possible to observe a change of ratio of metallic element (Zn) originated from the base member 51 in the electroplated layer. The decreased ratio of the metallic element (Zn) as being close to the base member in the thickness direction of the electroplated layer proves that a ratio of the first electroplated layer-metallic element (Zn) is decreased as being closer to the base member in the thickness direction of the electroplated layer.

Figure 13:
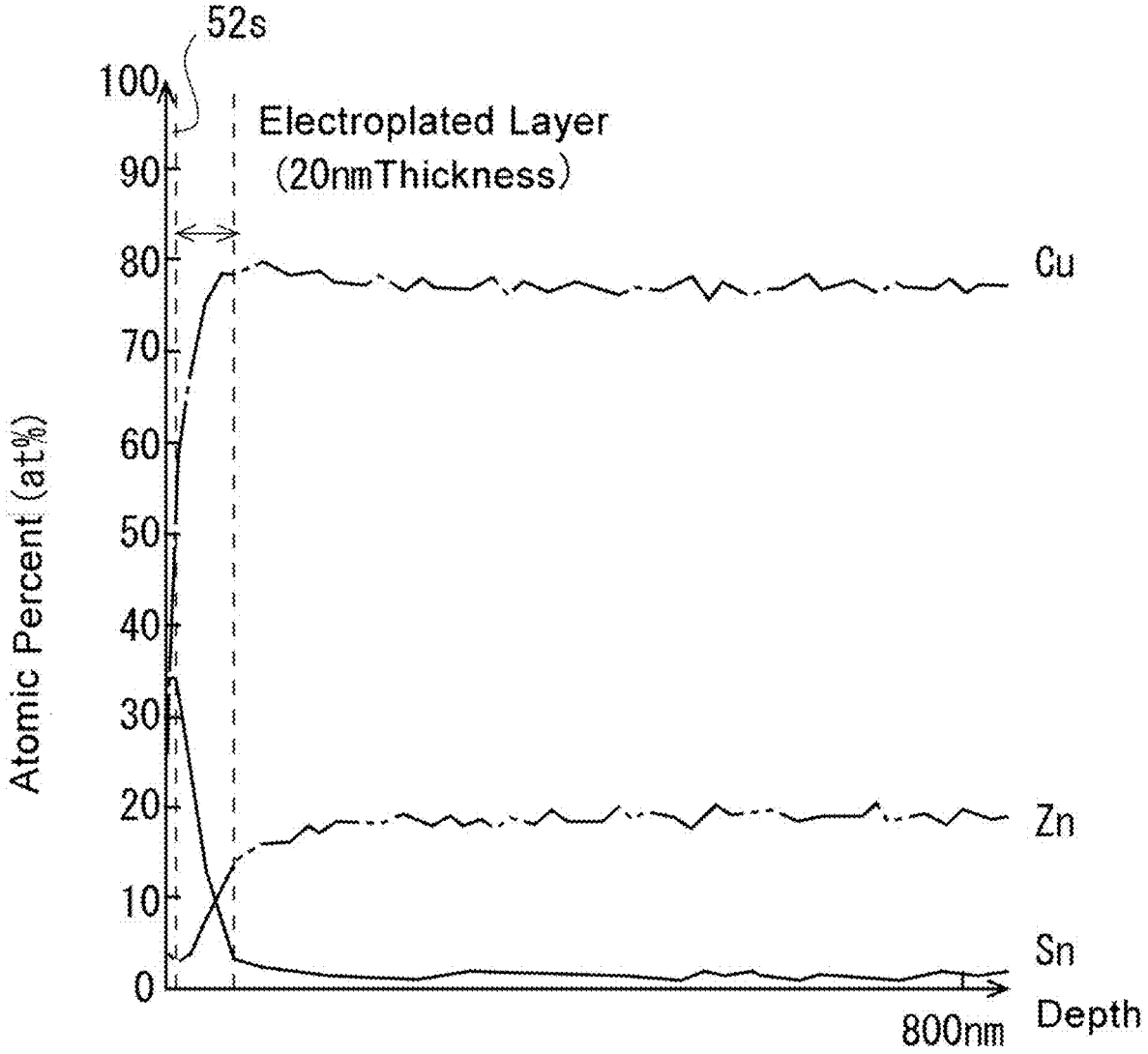
FIG. 13 is a schematic graph illustrating a change of ratio of respective metallic elements of an electroplated article in the thickness direction of an electroplated layer according to an aspect of the present disclosure. A ratio of a second electroplated layer-metallic element (Cu, Zn) in the electroplated layer is continuously decreased steeply as being away from the base member in the thickness direction of the electroplated layer. A ratio of a first electroplated layer-metallic element (Sn) is decreased as being closer to the base member in the thickness direction of the electroplated layer. A thickness of the electroplated layer is further reduced compared to the case of FIG. 4.

FIG. 13 is a schematic graph illustrating a change of ratio of respective metallic elements of an electroplated article in the thickness direction of an electroplated layer according to an aspect of the present disclosure. In FIG. 13, the base member 51 is made of brass (CuZn), and the first electroplated layer-metallic element is tin (Sn). A ratio of a second electroplated layer-metallic element (Cu or Zn) in the electroplated layer is continuously decreased steeply as being away from the base member in the thickness direction of the electroplated layer. A ratio of a first electroplated layer-metallic element (Sn) is decreased as being closer to the base member in the thickness direction of the electroplated layer. In a case of FIG. 13, a machine different from FIG. 4 is used to form an electroplated layer, and a remarkable effect can be obtained that the thickness of the electroplated layer can be thinner than the thickness of the electroplated layer of FIG. 4.

It should be noted that a thickness of an electroplated layer should not necessarily be limited to thicknesses of above described respective examples. For example, in the case of FIG. 13, if the thickness of electroplated layer is set to be greater than 20 nm, then an electroplated article may be obtained that has a color-appearance much closer to silver color that is a color of material of Sn. In contrast, if the thickness of electroplated layer is set to be less than 20 nm, then an electroplated article may be obtained that has a color-appearance much closer to yellow color that is a color of brass of the base member 51.

Figure 14:
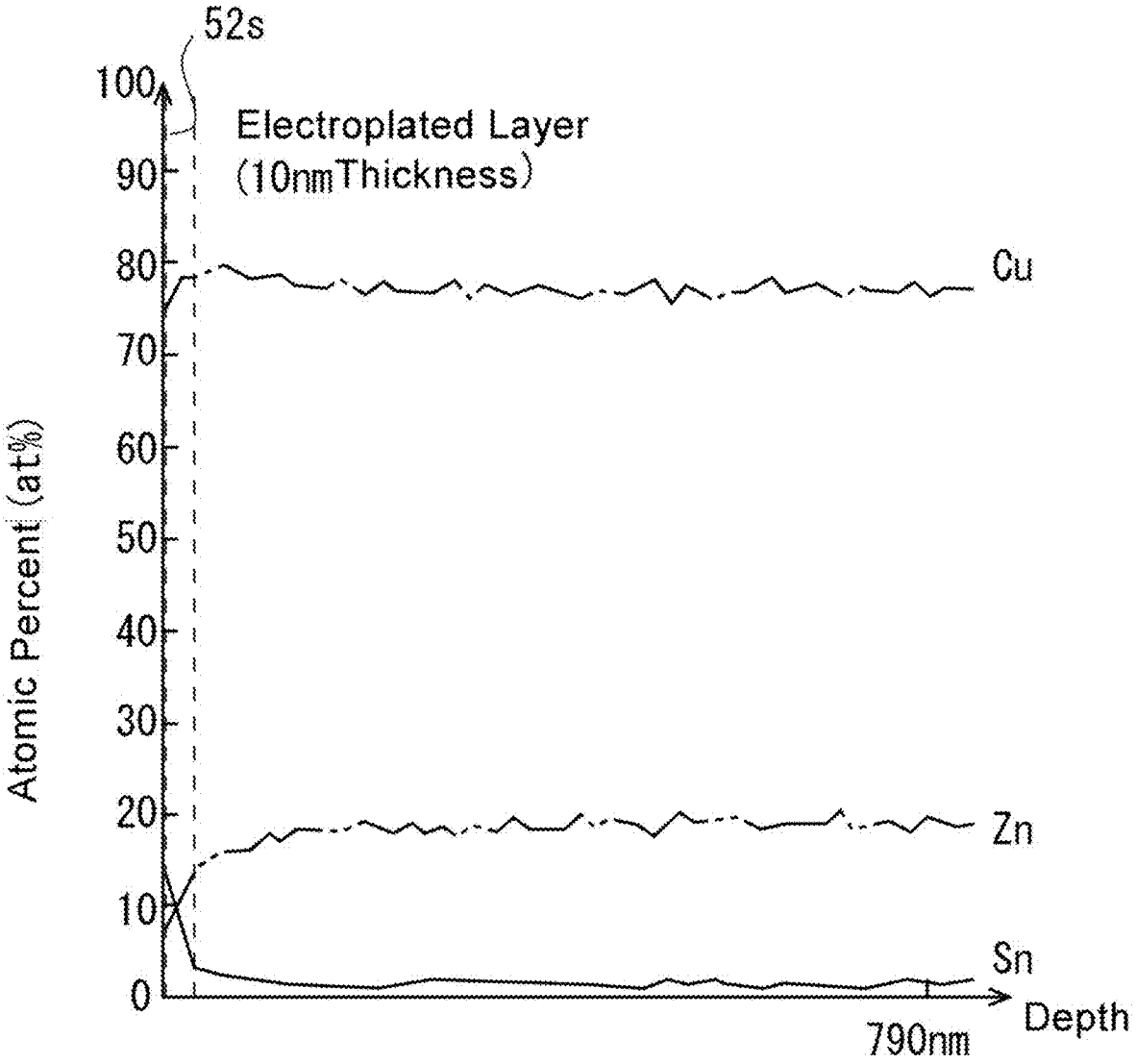
FIG. 14 is a schematic graph of a case where the electroplated layer is formed thinner than FIG. 13.

In particular, FIG. 14 illustrates an example where the thickness of the electroplated layer of FIG. 13 is set to be 10 nm. The electroplated article of this case may have a color-appearance with slightly increased yellow compared to the electroplated article of the embodiment of FIG. 13 that has a light gold color. As such, even in a case of embodiment of the present invention where the thickness is set to be 10 nm, a competitive electroplated article over conventional barrel plating in terms of cohesion will be obtained.

Figure 15:
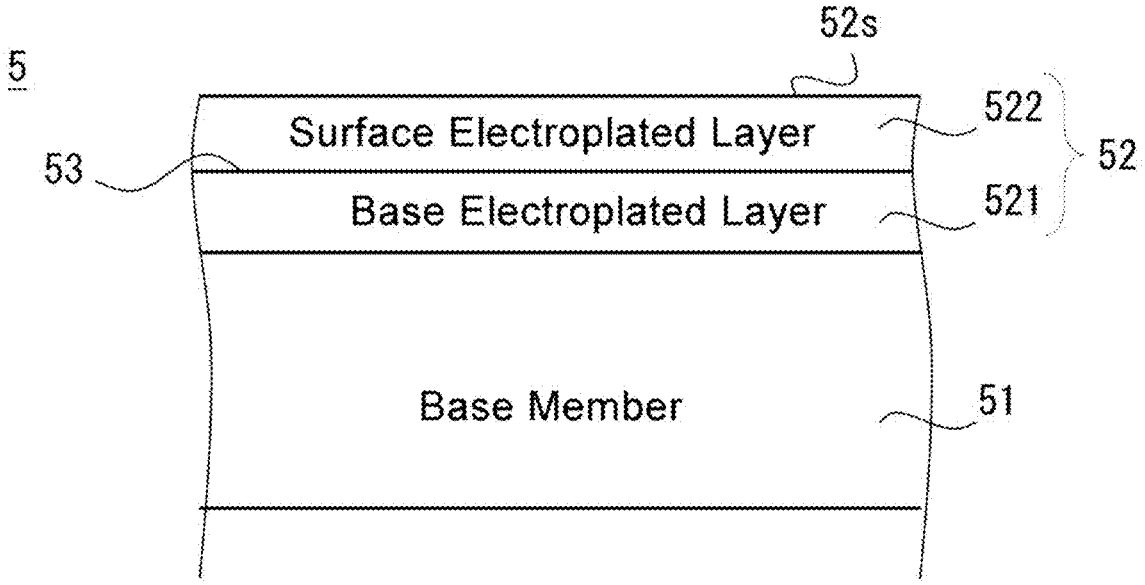
FIG. 15 is a view schematically illustrating a layer structure of an electroplated article according to an aspect of the present disclosure, illustrating that an electroplated layer formed directly on the base member includes a base electroplated layer and a surface electroplated layer.
Figure 16:
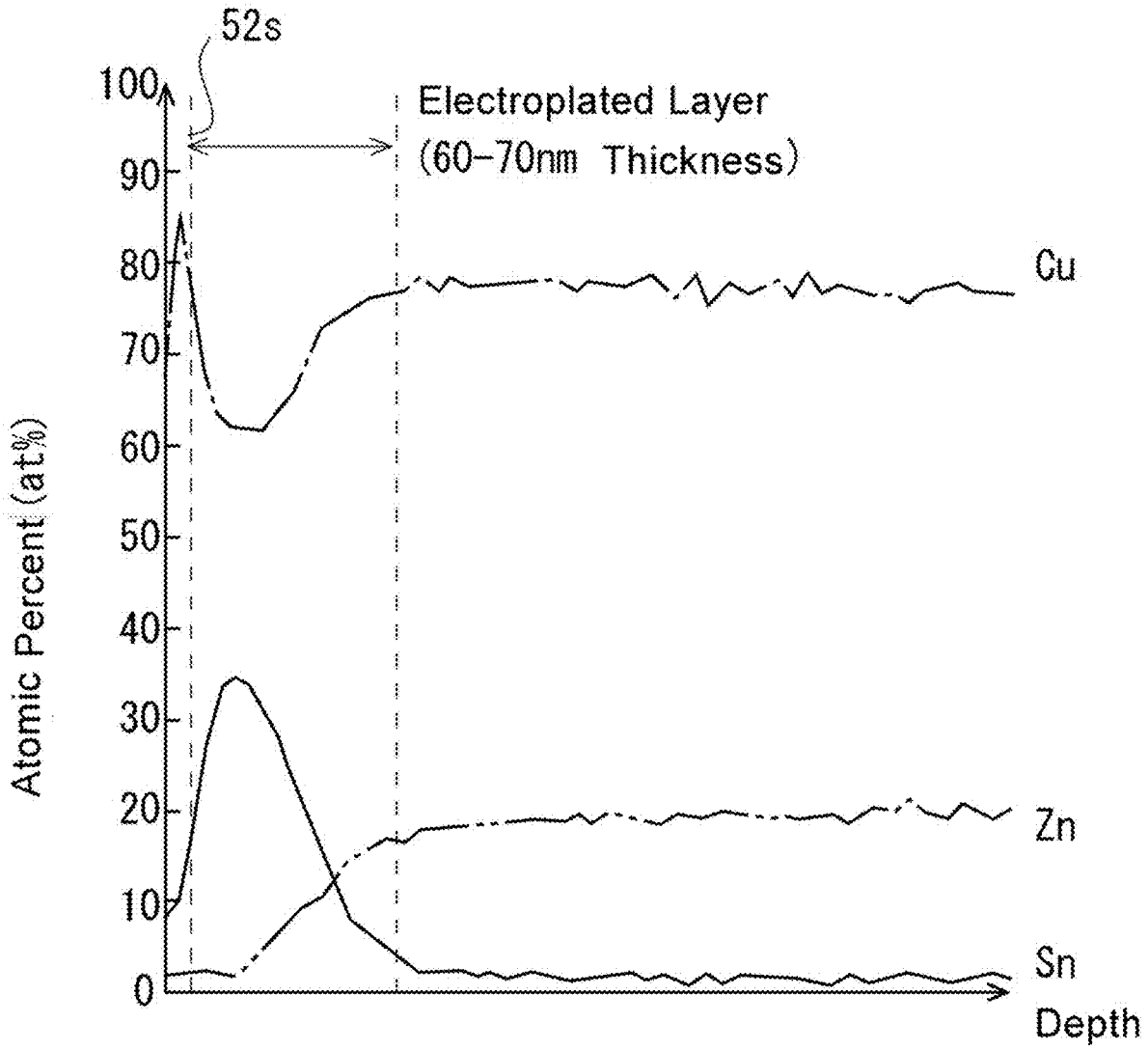
FIG. 16 is a schematic graph illustrating a change of ratio of respective metallic elements of an electroplated article in the thickness direction of an electroplated layer according to an aspect of the present disclosure. A base electroplated layer is made of first electroplated layer-metallic element (Sn). A surface electroplated layer is made of another first electroplated layer-metallic element (Cu).

FIG. 15 is a view schematically illustrating a layer structure of an electroplated article, illustrating that an electroplated layer formed directly on the base member includes a base electroplated layer and a surface electroplated layer. FIG. 16 is a schematic graph illustrating a change of ratio of respective metallic elements of an electroplated article in the thickness direction of an electroplated layer. In FIG. 16, the electroplated layer is comprised of a base electroplated layer and a surface electroplated layer as shown in FIG. 15. In FIG. 16, the base member 51 is made of CuZn, and the first electroplated layer-metallic element of the base electroplated layer is tin (Sn), and the first electroplated layer-metallic element of the surface electroplated layer is copper (Cu). A ratio of a second electroplated layer-metallic element (Cu or Zn) in the electroplated layer is continuously decreased as being away from the base member in the thickness direction of the electroplated layer. A ratio of a first electroplated layer-metallic element (Sn) in the base electroplated layer is continuously decreased as being closer to the base member in the thickness direction of the electroplated layer.

A ratio of a second electroplated layer-metallic element (Zn) in the surface electroplated layer is continuously decreased as being away from the base electroplated layer in the thickness direction of the electroplated layer, and similarly a ratio of the first electroplated layer-metallic element (Sn) of the base electroplated layer is continuously decreased. In a case of FIG. 16, the first electroplated layer-metallic element of the surface electroplated layer is copper (Cu), and thus it is not possible to observe a change of ratio of the metallic element (Cu) in the surface electroplated layer which is originated from the base member 51. The decreased ratio of the metallic element (Cu) of the surface electroplated layer as being close to the base electroplated layer in the thickness direction of the electroplated layer proves that a ratio of the metallic element (Cu) originated from the base member 51 in the surface electroplated layer is decreased as being closer to the base electroplated layer in the thickness direction of the surface electroplated layer.

Examples where brass is used for the base member 51 have been mainly described, but it is envisaged that other metal (zinc or stainless steel, for example), alloy or pure metal (such as zinc) can be used. It is envisaged that, in some cases, the electroplated layer is formed as a single layer, dual layers or three or more layers. The surface position of the electroplated layer 52 is pointed out by "52*s*" in FIGS. 4, 11-14, and 16-18.

Figure 17:
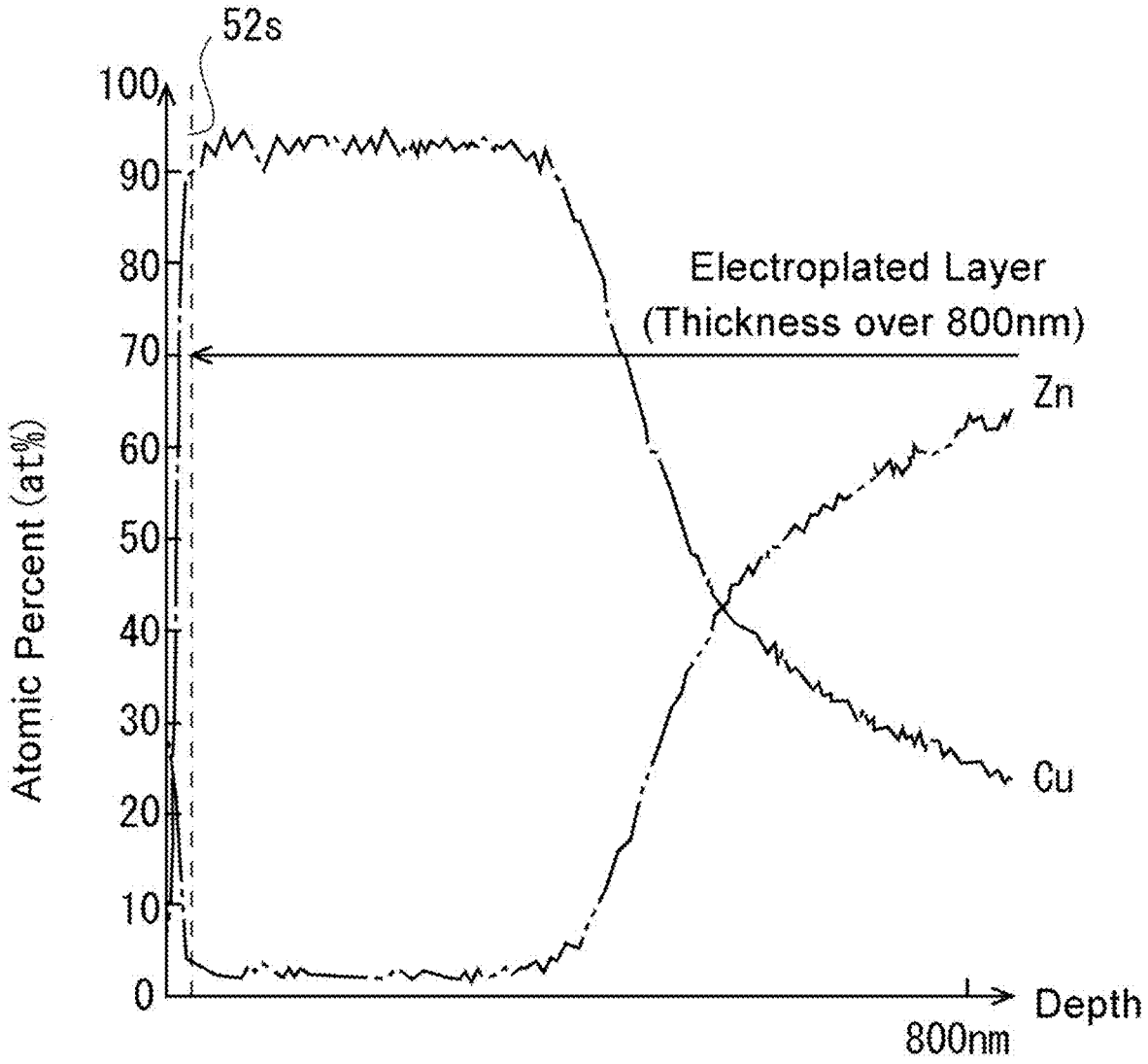
FIG. 17 is a schematic graph illustrating a change of ratio of respective metallic elements of an electroplated article in the thickness direction of an electroplated layer according to an aspect of the present disclosure. A ratio of a second electroplated layer-metallic element (Zn) in the electroplated layer is continuously decreased as being away from the base member in the thickness direction of the electroplated layer. A ratio of a first electroplated layer-metallic element (Cu) is decreased as being closer to the base member in the thickness direction of the electroplated layer.

FIG. 17 is a schematic graph illustrating a change of ratio of respective metallic elements of an electroplated article in the thickness direction of an electroplated layer. In FIG. 17, the base member 51 is made of zinc (Zn), and the first electroplated layer-metallic element of the electroplated layer is copper (Cu). A ratio of a second electroplated layer-metallic element (Zn) in the electroplated layer is continuously decreased as being away from the base member in the thickness direction of the electroplated layer. A ratio of a first electroplated layer-metallic element (Cu) is decreased as being closer to the base member in the thickness direction of the electroplated layer.

Figure 18:
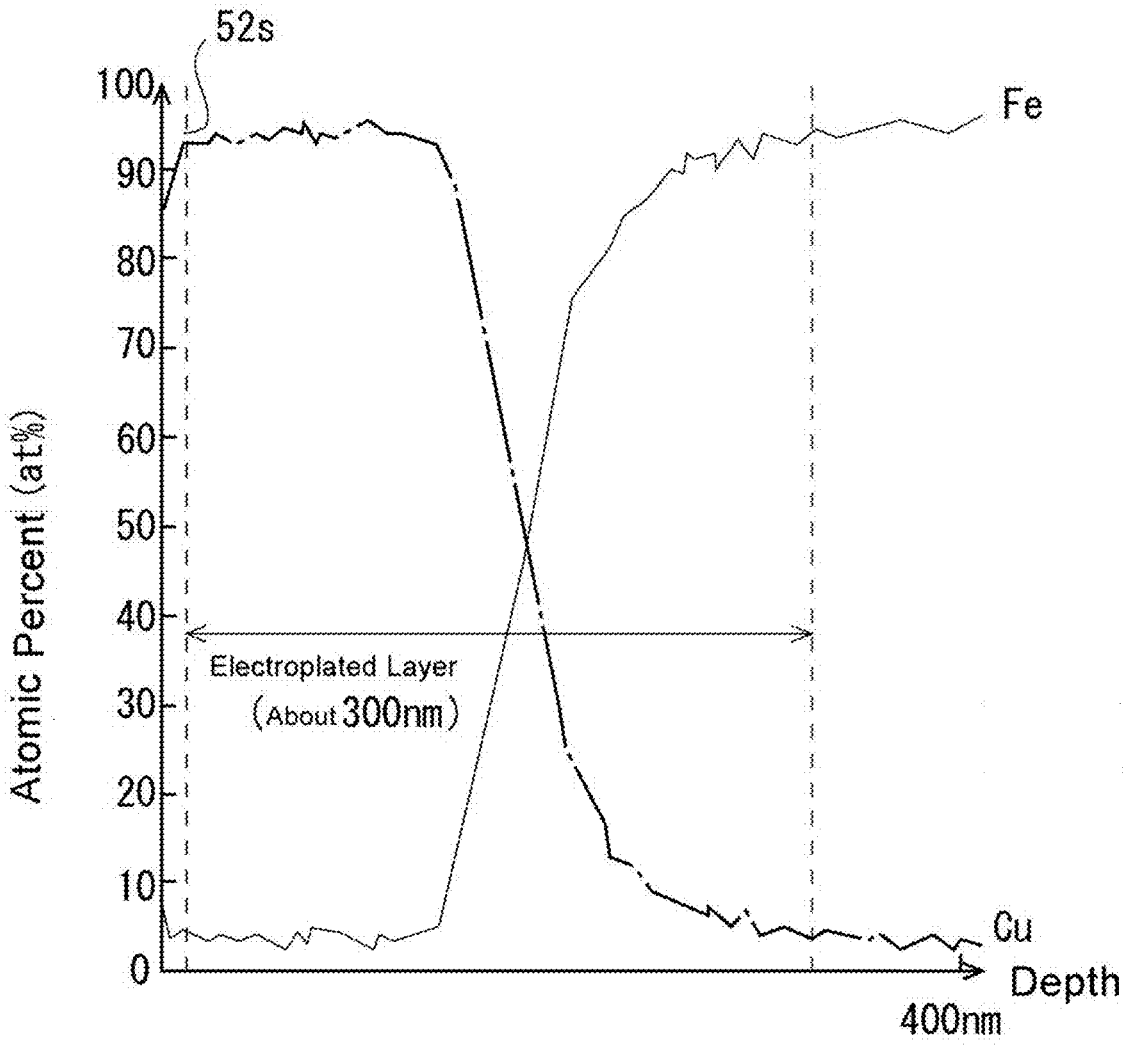
FIG. 18 is a schematic graph illustrating a change of ratio of respective metallic elements of an electroplated article in the thickness direction of an electroplated layer according to an aspect of the present disclosure. A ratio of a second electroplated layer-metallic element (Fe) in the electroplated layer is continuously decreased as being away from the base member in the thickness direction of the electroplated layer. A ratio of a first electroplated layer-metallic element (Cu) is decreased as being closer to the base member in the thickness direction of the electroplated layer.

FIG. 18 is a schematic graph illustrating a change of ratio of respective metallic elements of an electroplated article in the thickness direction of an electroplated layer. In FIG. 18, the base member 51 is made of stainless steel, and includes a base member-metallic element (Fe). The first electroplated layer-metallic element of the electroplated layer is copper (Cu). A ratio of a second electroplated layer-metallic element (Fe) in the electroplated layer is continuously decreased as being away from the base member in the thickness direction of the electroplated layer. A ratio of a first electroplated layer-metallic element (Cu) is decreased as being closer to the base member in the thickness direction of the electroplated layer.

As would be understood from the above disclosure, in some cases, a thickness of a portion of the electroplated layer 52 where the ratio of the second electroplated layer-metallic element is continuously decreased as being away from the base member 51 in the thickness direction of the electroplated layer 52 is equal to or greater than 10 nm or 20 nm or 60 nm. FIG. 17 shows that a ratio of the second electroplated layer-metallic element (Zn) is continuously decreased in the thickness range equal to or greater than 60 nm and/or 400 nm. FIG. 18 shows that a ratio of the second electroplated layer-metallic element (Fe) is decreased in the thickness range equal to or greater than 60 nm and/or 100 nm. FIG. 4 shows that a ratio of the second electroplated layer-metallic element (Cu) is continuously decreased in the thickness range equal to or greater than 60 nm. FIG. 4 shows that a ratio of the second electroplated layer-metallic element (Zn) is continuously decreased in the thickness range equal to or greater than 40 nm. FIG. 11 and FIG. 12 are similar to FIG. 4. FIG. 13 shows that a ratio of the second electroplated layer-metallic element (Cu, Zn) continuously decreased steeply in the thickness range equal to or greater than 10 nm and/or 20 nm.

As would be understood from the above disclosure, in some cases, a thickness of a portion of the electroplated layer 52 where the ratio of the second electroplated layer-metallic element is continuously decreased as being away from the base member 51 in the thickness direction of the electroplated layer 52 is equal to or less than 80 nm or 60 nm or 30 nm or 20 nm. FIG. 4 shows that a ratio of the second electroplated layer-metallic element (Cu, Zn) is continuously decreased in the thickness range equal to or less than 80 nm or 60 nm. The same applies to FIG. 11 and FIG. 12. FIG. 13 shows that a ratio of the second electroplated layer-metallic element (Cu, Zn) is continuously decreased steeply in the thickness range equal to or less than 30 nm and/or 20 nm.

As would be understood from the above disclosure, in some cases, a ratio of the first electroplated layer-metallic element at a surface of the electroplated layer 52 is less than 100% or 90%. The ratio of the first electroplated layer-metallic element at the top surface of the electroplated layer 52 is less than 100% because of the second electroplated layer-metallic element in the electroplated layer. The ratio of the first electroplated layer-metallic element at the surface of the electroplated layer 52 is less than 100% theoretically or less than 90% even considering foreign body or measurement errors. For example, in the embodiment of FIG. 13, an electroplating ends when Sn of the first electroplated layer-metallic element reaches 35%. In the conventional barrel plating, a ratio of electroplated layer-metallic element at a surface of an electroplated article at the time of end of electroplating will be 100% theoretically or will be equal to or greater than 90% even considering foreign body or measurement errors. Electroplated articles having slightly different color-appearance may be easily produced by stopping an electroplating in an electroplated condition with desired color-appearance.

Figure 19:
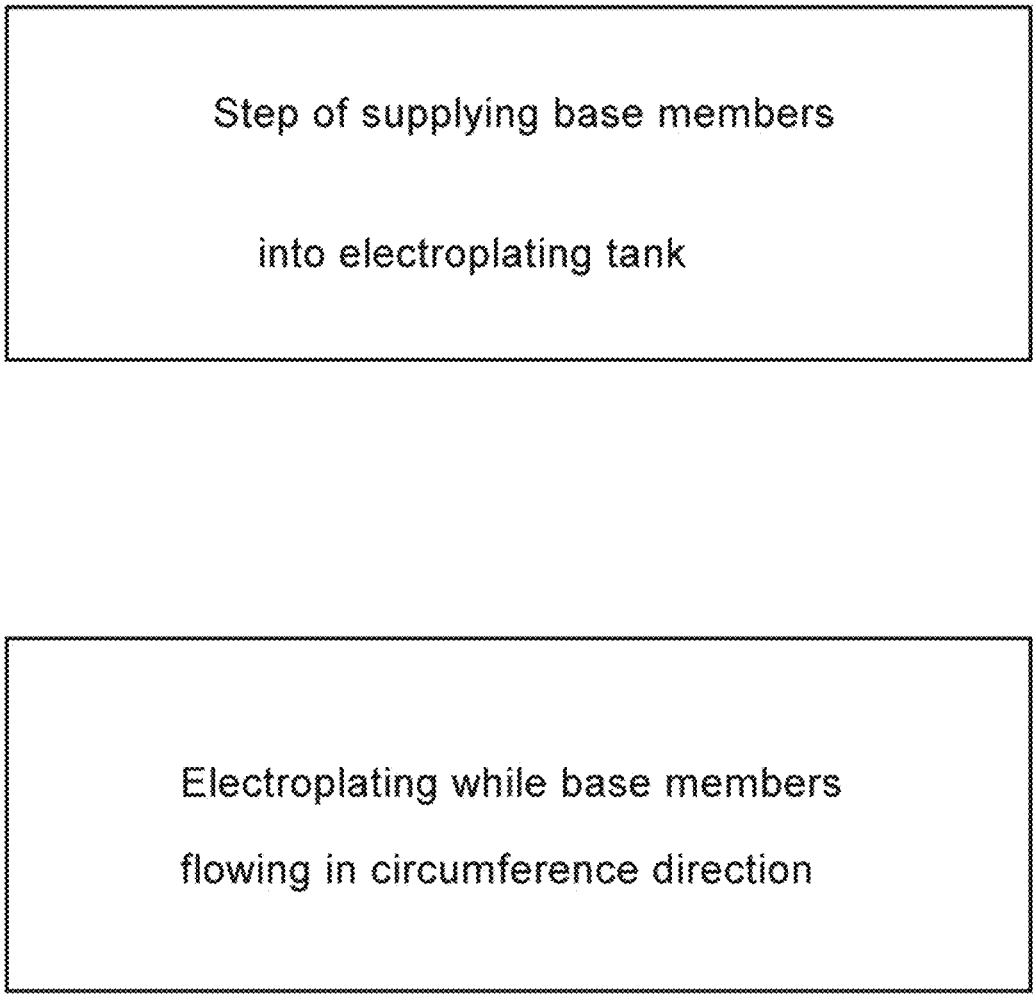
FIG. 19 is a schematic flowchart showing a non-limiting exemplary method of manufacturing electroplated articles according to an aspect of the present disclosure.
Figure 20:
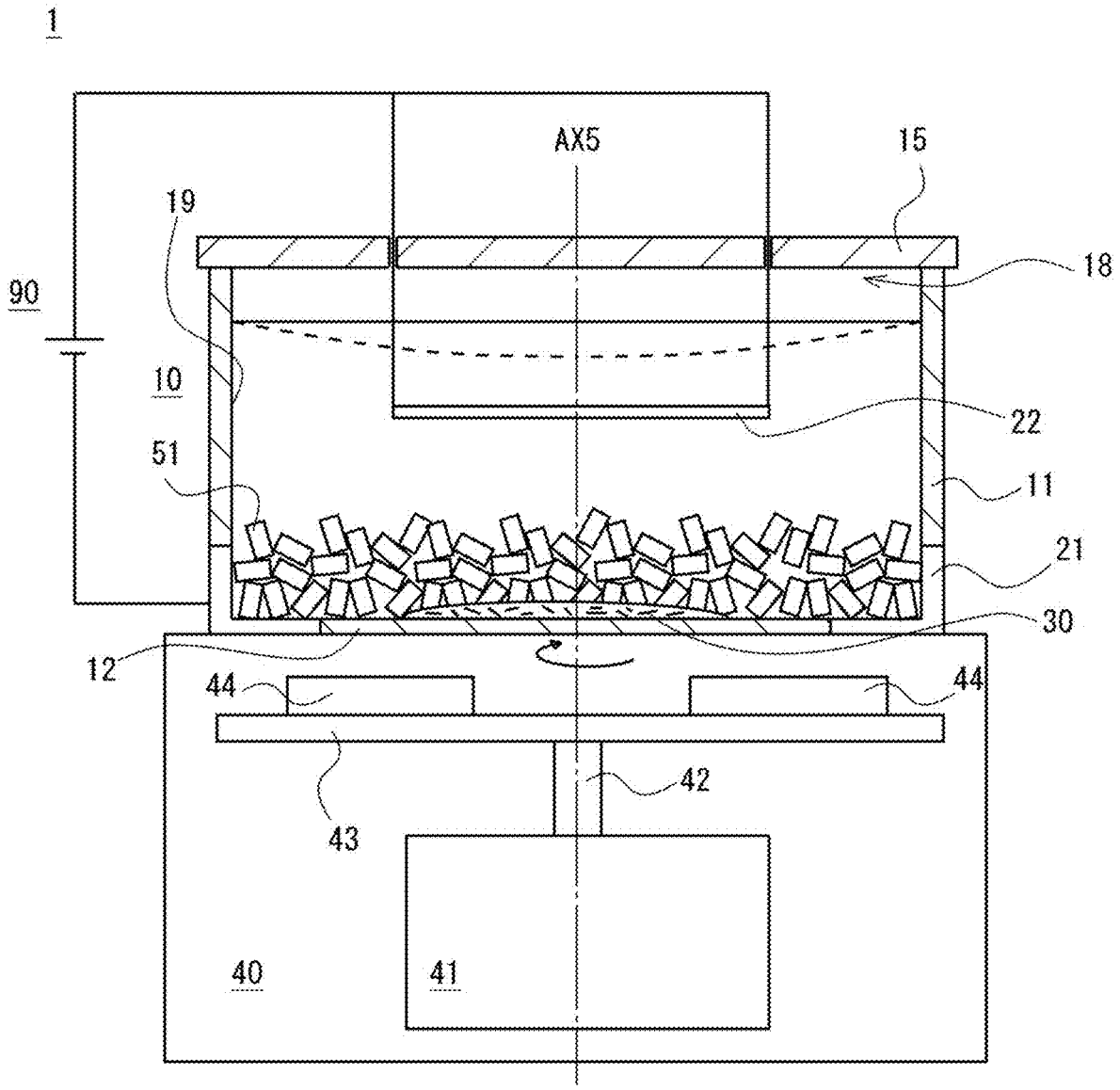
FIG. 20 is a view showing a schematic configuration of a non-limiting exemplary apparatus for electroplating usable for manufacturing electroplated articles according to an aspect of the present disclosure.
Figure 23:
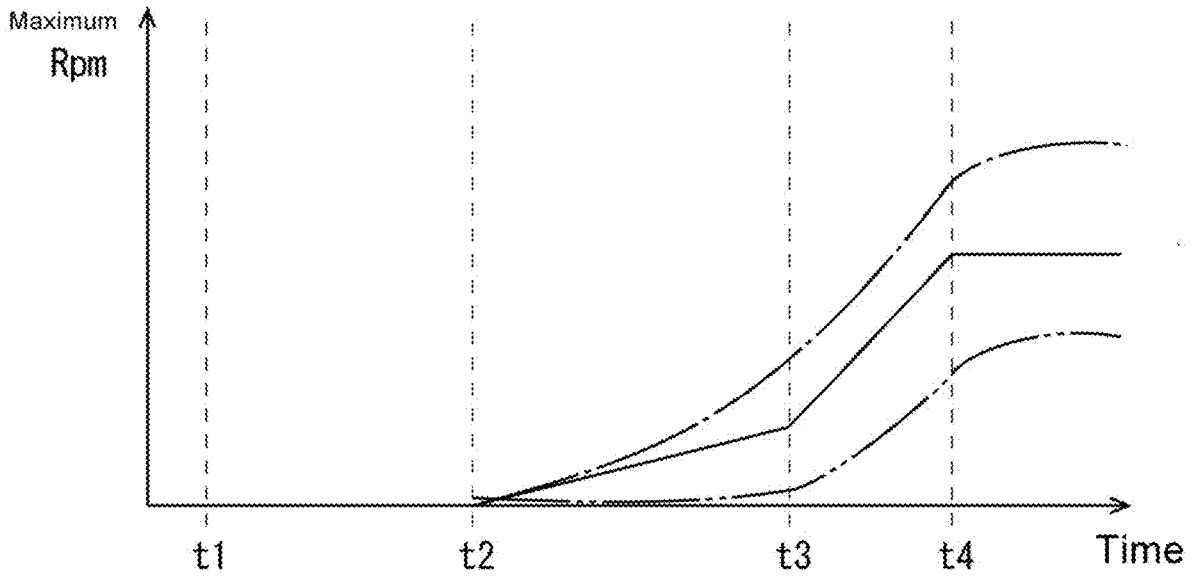
FIG. 23 is a schematic graph showing increase of the maximum rpm of base member in accordance with time progress of agitation and electroplating steps.
Figure 24:
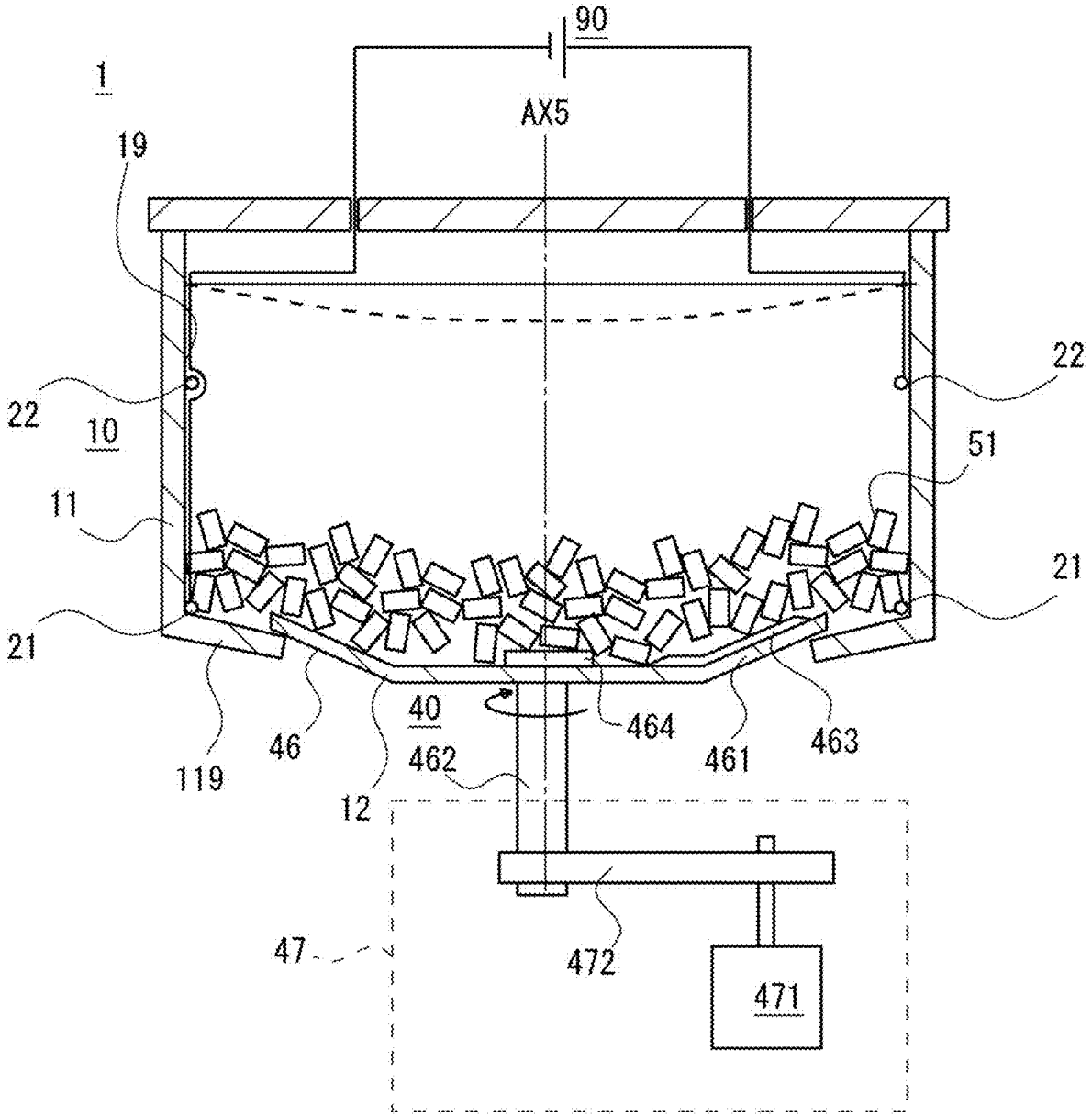
FIG. 24 is a view showing a schematic configuration of a non-limiting exemplary apparatuses for electroplating usable for manufacturing electroplated articles according to an aspect of the present disclosure.
Figure 25:
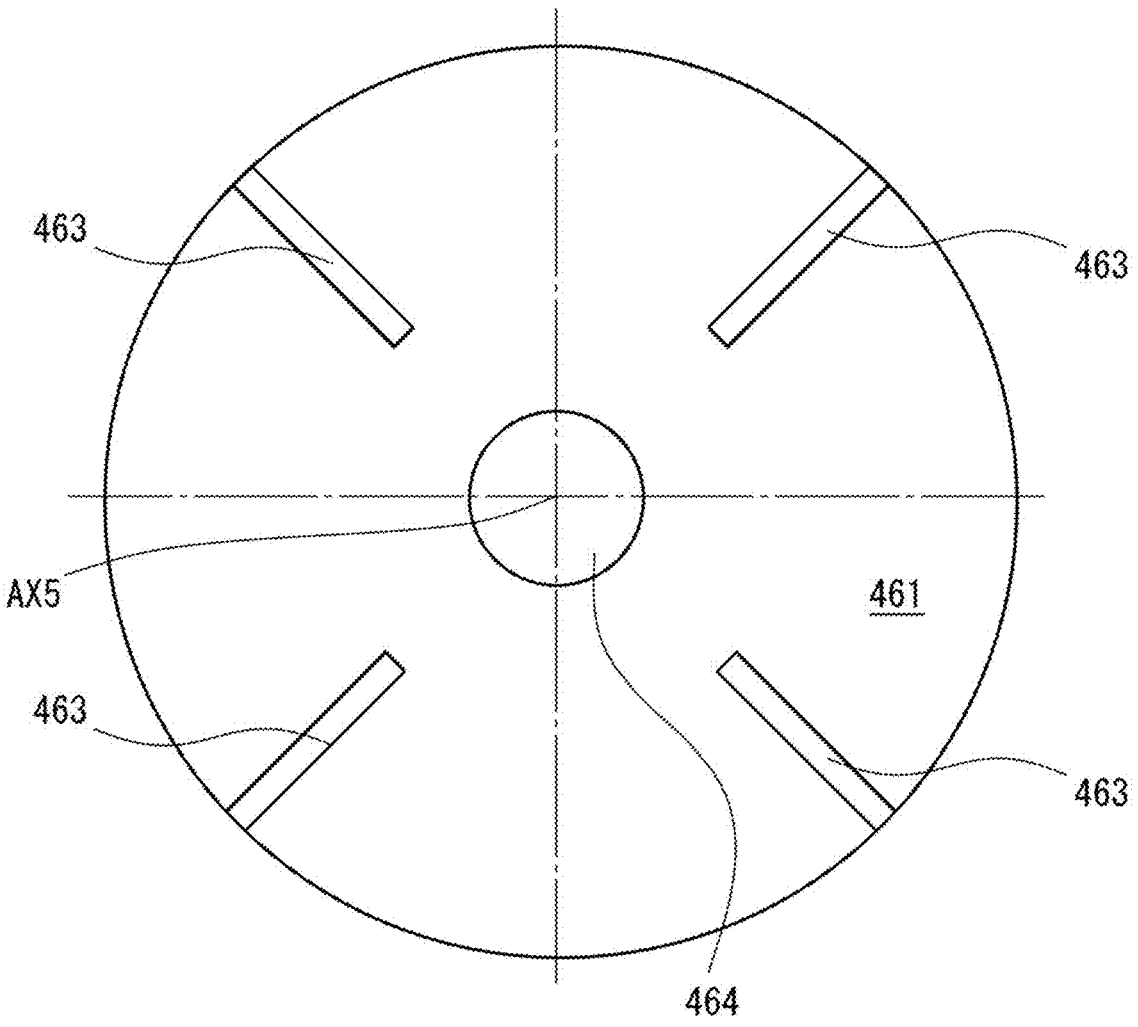
FIG. 25 is a schematic top view of an agitation unit of an apparatuses for electroplating shown in FIG. 24, showing that an agitation unit includes a radial array of upwardly projecting blades.
Figure 26:
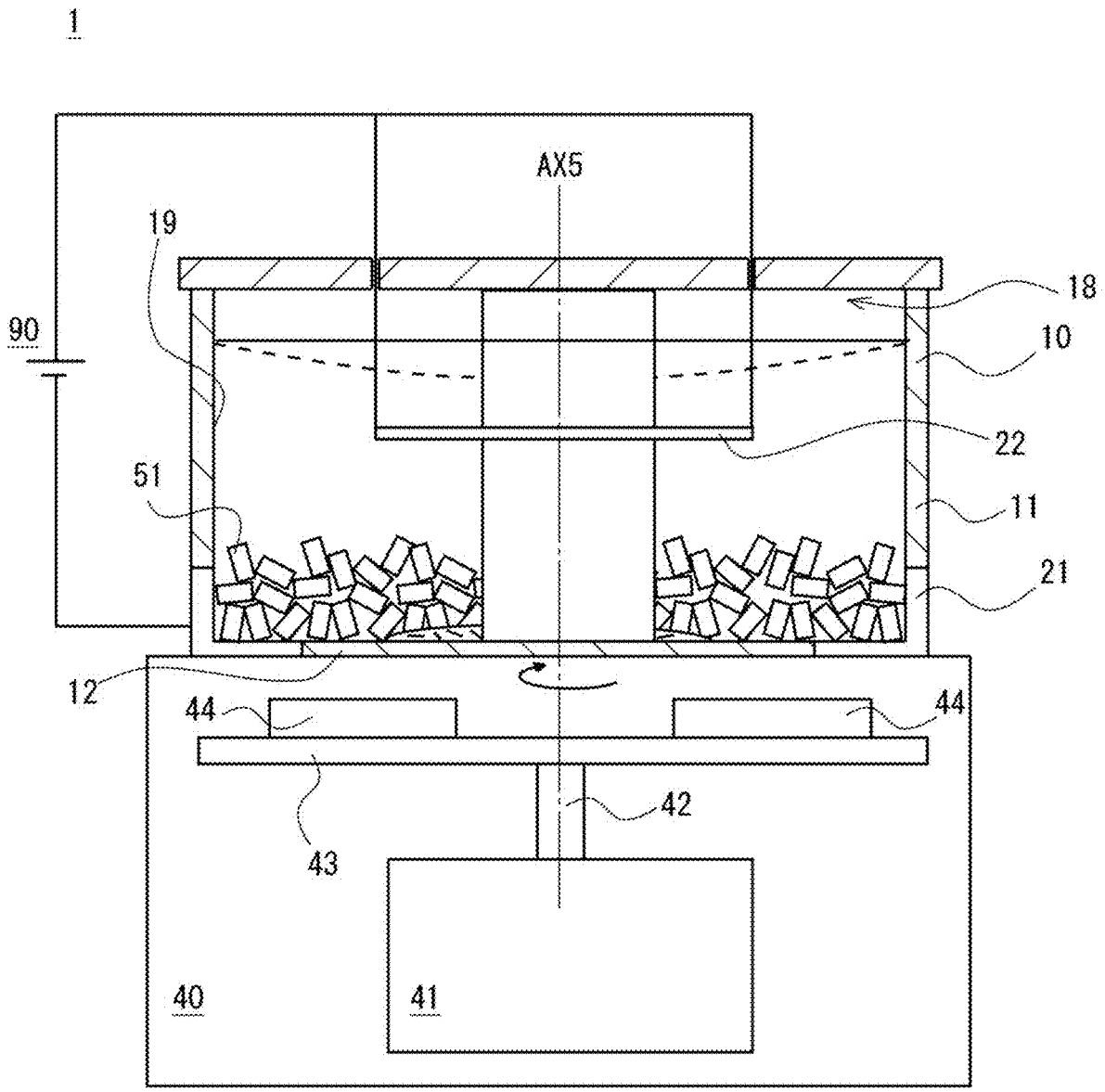
FIG. 26 is a view showing a schematic configuration of an apparatuses for electroplating according to another embodiment of the present disclosure, showing an example where hollow or non-hollow cylinder is provided at the center of the electroplating tank.
Figure 27:
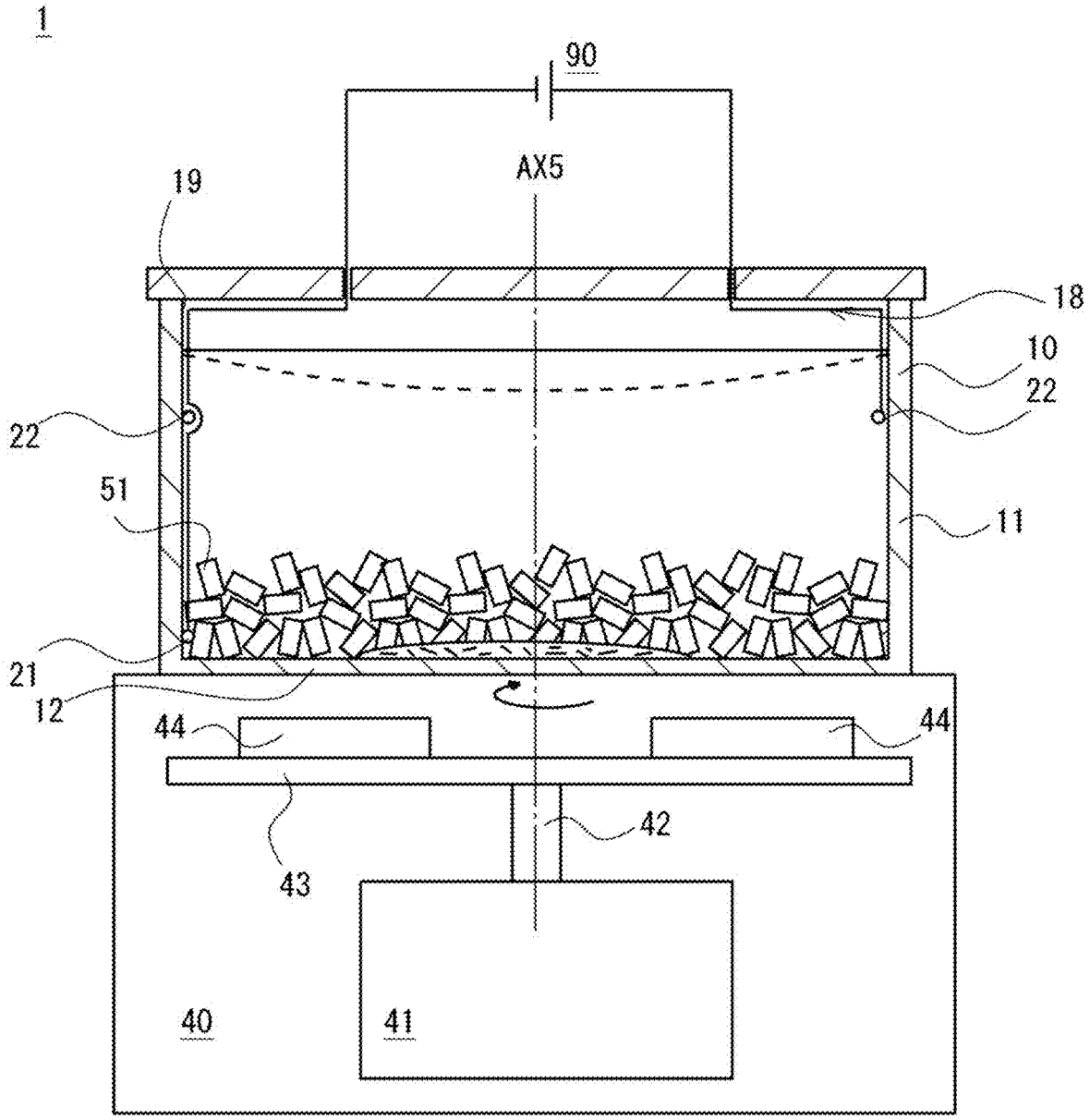
FIG. 27 is a view showing a schematic configuration of an apparatuses for electroplating according to another embodiment of the present disclosure, showing an example where a cathode and an anode are arranged differently.
Figure 28:
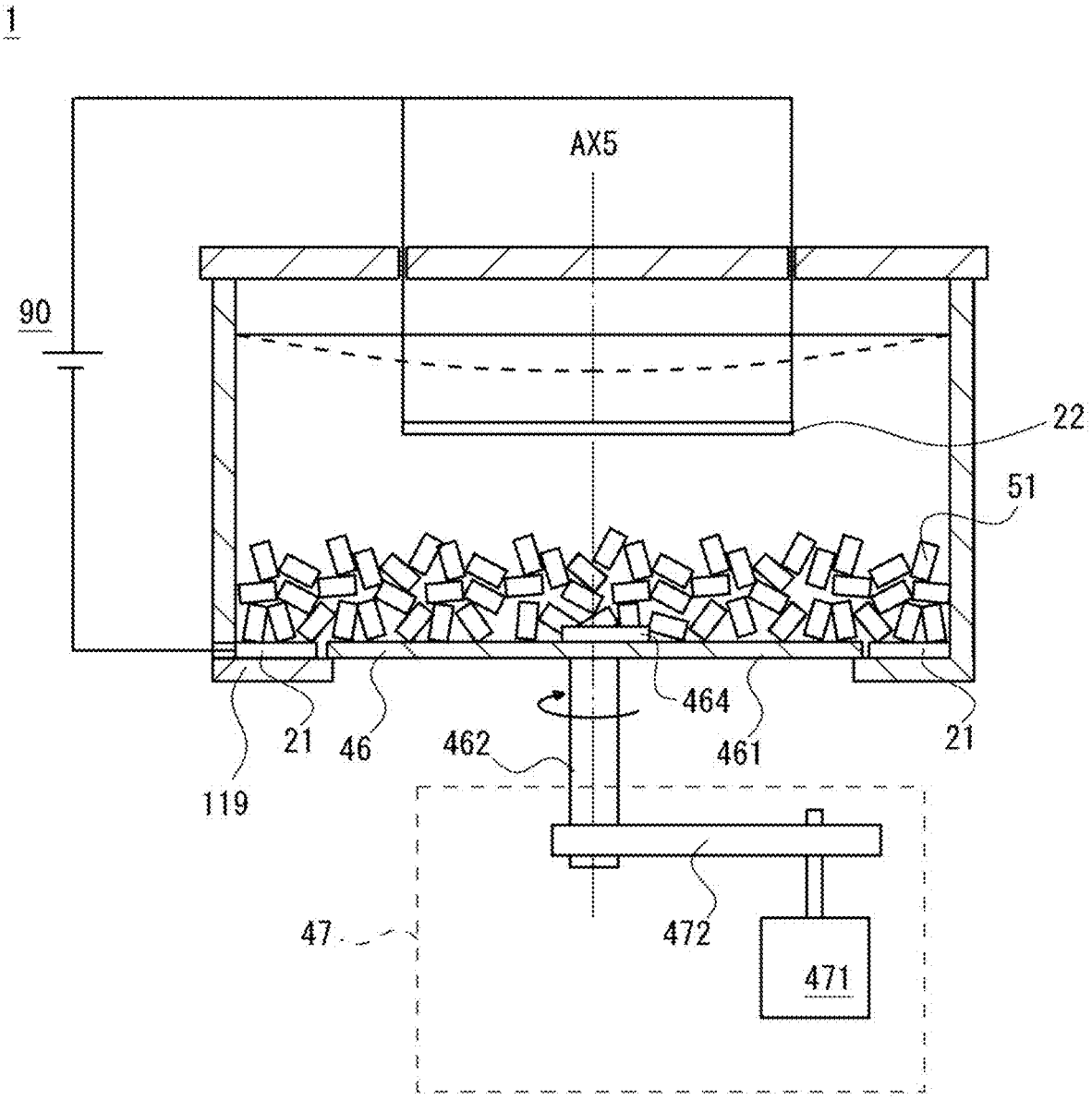
FIG. 28 is a view showing a schematic configuration of an apparatuses for electroplating according to another embodiment of the present disclosure, showing a plate-like agitation unit.

Hereinafter, a method of manufacturing a non-limiting exemplary electroplated article (or an electroplating method) and a configuration of an electroplating apparatus used for that methods will be described with reference to FIGS. 19-28. It should be noted that FIGS. 19-28 and related descriptions will not give any limitation to the above-described electroplated articles. FIG. 19 is a schematic flowchart showing a non-limiting exemplary method of manufacturing electroplated articles. FIG. 20 is a view showing a schematic configuration of a non-limiting exemplary apparatus for electroplating usable for manufacturing electroplated articles. FIG. 21 is a schematic top view of an electroplating tank of an apparatus for electroplating, showing an exemplary arrangement of cathode and anode in an electroplating tank and also showing a low-friction member provided on a bottom portion of an electroplating tank. FIG. 22 is a schematic partial sectional view of an apparatus for electroplating along X22-X22 in FIG. 21. FIG. 23 is a schematic graph showing increase of the maximum rpm of base member in accordance with time progress of agitation and electroplating steps. FIG. 24 is a view showing a schematic configuration of a non-limiting exemplary apparatuses for electroplating usable for manufacturing electroplated articles. FIG. 25 is a schematic top view of an agitation unit of an apparatuses for electroplating shown in FIG. 24, showing that an agitation unit includes a radial array of upwardly projecting blades. FIG. 26 is a view showing a schematic configuration of an apparatuses for electroplating, showing an example where hollow or non-hollow cylinder is provided at the center of the electroplating tank. FIG. 27 is a view showing a schematic configuration of an apparatuses for electroplating, showing an example where a cathode and an anode are arranged differently. FIG. 28 is a view showing a schematic configuration of an apparatuses for electroplating, showing a plate-like agitation unit.

As shown in FIG. 19, a method of manufacturing electroplated articles may include a step of supplying base members each including a base member-metallic element into an electroplating tank, and a step of flowing the base members in a circumference direction and electroplating the base members in the electroplating tank. An electroplated layer, which has a first electroplated layer-metallic element that is different from the base member-metallic element, is formed directly on the base member by that electroplating method. As described above, the electroplated layer formed as such further includes the base member-metallic element. As described above, a ratio of the second electroplated layer-metallic element in the electroplated layer is decreased as being away from the base member in the thickness direction of the electroplated layer and/or a clear interface does not exist between the base member and the electroplated layer. Other features described in relation to the electroplated article 5 will be effective for the electroplated article described in this paragraph. Based on the following disclosure, the above-described "step of flowing the base members in a circumference direction and electroplating the base members in the electroplating tank" would be understood to include a step of agitating a multiple of base members that has been immersed in an electrolytic solution inside of an electroplating tank so as to flow in a circumference direction along an inner wall of the electroplating tank.

An electroplating apparatus 1 according to some exemplary embodiments as shown in FIGS. 20 and 24 is equipped with an electroplating tank 10 that is filled with an electrolytic solution, and an agitation mechanism 40 that causes a multiple of base members 51 to flow that have been immersed in the electrolytic solution stored in the electroplating tank 10. The electrolytic solution may be a cyanide electrolytic solution, for example. The base member 51 may be referred to as an article to be electroplated in some cases. The circumstantial flow of the base members 51 is cause in accordance with actuation of the agitation mechanism 40 and electroplating is also performed simultaneously. In some cases, the agitation mechanism 40 causes a multiple of base members 51 that has been immersed in the electrolytic solution inside of the electroplating tank 10 to flow in a circumference direction along an inner wall 19 of the electroplating tank 10 while the multiple of base members 51 are kept substantially submerged condition.

The agitation mechanism 40 in some exemplary cases of FIG. 20 magnetically affects a multiple of magnetic media 30 in the electrolytic solution in the electroplating tank 10 to flow the multiple of magnetic media 30. When the magnetic media 30 flow, the magnetic media 30 hit the base member 51. Impetus of the magnetic media 30 transmits to the base members 51, and the base members 51 start to flow. Due to continuous or periodical collisions between the magnetic media 30 and the base members 51, a flow of the base members 51 is maintained or facilitated. Due to contacts and collisions between the base members 51 and contacts and collisions between the base members 5 and the magnetic media 30, the base members 51 and the electroplated layers 52 are polished.

In some cases of exemplary FIG. 24, the agitation mechanism 40 causes a multiple of base members 51 to flow in the circumference direction by rotation of an agitation unit 46 that is provided at a bottom side of the electroplating tank 10. The agitation mechanism 40 is provided with an agitation unit 46 that is provided rotatably at the bottom side of the electroplating tank 10, and a torque-supply mechanism 47 to supply torque to the agitation unit 46. In accordance with rotation of the agitation unit 46, each base member 51 flows in the circumference direction. The base members 51 and the electroplated layers 52 are polished by contacts and collisions between the base members 51 before electroplated layers 52 are formed or between the base members 51 onto which electroplated layers 52 are growing.

In some cases, the agitation unit 46 is provided rotatably at the bottom side of the electroplating tank 10, and configures at least a portion of a bottom portion of the electroplating tank 10. In accordance with rotation of the agitation unit 46, at least a portion of the bottom portion of the electroplating tank 10 rotates relative to a tubular portion 11 of the electroplating tank 10.

In some cases, the electroplating tank 10 includes a tubular portion 11 and a bottom portion 12. The tubular portion 11 is a cylindrical tube that has an opening 18 at its top portion which allows throw-in and recovery of the base members 51. A bottom end of the tubular portion 11 is provided with the bottom portion 12. The electroplating tank 10 and the tubular portion 11 are stationary members. The tubular portion 11 is arranged such that the central axis of the tubular portion 11 matches a rotational axis AX5 described below. The central axis of the tubular portion 11 and the rotational axis AX5 match the vertical direction in some cases. Therefore, a multiple of base members 51 thrown into the electroplating tank 10 sink downward vertically in the electrolytic solution and deposits on the bottom portion 12.

In some cases, the electroplating apparatus 1 is equipped with a bottom cathode 21 provided at a bottom side of the electroplating tank 10, and a top anode 22 provided upward relative to the bottom cathode 21. The bottom side is equal to a direction that the base member 51 sinks which are thrown into the electrolytic solution in the electroplating tank 10. The bottom cathode 21 is connected to an anode of a power source 90, and the top anode 22 is connected to a cathode of the power source 90.

Metal ions released or eluted from the top anode 22 into the electrolytic solution or metal ions which have been already provided in the electrolytic solution receive electrons from a base member 51 that is directly touching the bottom cathode 21, or receive electrons from a base members 51 that is electronically connected to the bottom cathode 21 via another base members 51. Metal ions deposit on the base member 51 once receiving the electrons, and thus an electroplated layer is formed. The base member 51 touching the bottom cathode 21 can supply electrons, transferred from the bottom cathode 21 to this base member 51, to the metal ions. The base member 51, not directly touching the bottom cathode 21 and being electrically connected to the bottom cathode 21 via other one or more base members 51, can supply electrons, originated from the bottom cathode 21 and transferred via other one or more base members 51, to the metal ions.

In some embodiments, a multiple of base members 51 flows in the circumference direction while being kept at substantially submerged condition in the electrolytic solution stored in the electroplating tank 10. At least one of the multiple of base members 51 touches the bottom cathode 21, and base members positioned upward relative to the base member 51 touching the bottom cathode 21 are electrically connected to the bottom cathode 21 via at least the base members 51 touching the bottom cathode 21. In other words, the multiple of base members 51 may include a plurality of base member 51 belonging to a first subset which is electrically connected to the bottom cathode 21 by touching the bottom cathode 21, and a plurality of the base member 51 belonging to a second subset which does not touch the bottom cathode 21 and is electrically connected to the bottom cathode 21 via at least one base member 51 belonging to the first subset. The multiple of base members 51 may include a plurality of the base member 51 belonging to a third subset which is electrically connected to the bottom cathode 21 via at least one base member 51 belonging to the first subset and at least one base member 51 belonging to the second subset. The circumferential flow of the base members 51 being kept at substantially submerged condition indicates that a large number of the base members 51 do not come to float in the electrolytic solution. The circumferential flow of the base members 51 being kept at substantially submerged condition does not exclude but include temporal floating of base members 51 due to accidental turbulence of flow of electrolytic solution or collisions between base members 51. In a specific case, the circumferential flow of the base members 51 being kept at substantially submerged condition indicates that, while the electroplating solution or the base members 51 are flowing at the maximum circulation speed, a majority of base members 51 touches the bottom portion of electroplating tank 10 or other base members 51, except for a quite small number of base members 51 which are temporarily floating due to accidental turbulence of flow of electrolytic solution or collisions between base members 51. Accordingly, it would be possible to surely secure electrical connection between the base member 51 and the bottom cathode 21, and to avoid that the base members 51 are rendered to be in a power non-supply condition.

In a common barrel plating, a multiple of base members 51 is agitated and electroplated while circulation speed of barrel is set at a low speed of 3 to 8 rpm, and thus it takes a longer time period to produce even and shade-less electroplated articles. In contrast, according to a method of the present disclosure, shortening of a required time period for producing even and shade-less electroplated articles may be facilitated. In some cases, the time period of electroplating is half of that required for a barrel plating.

The bottom cathode 21 extends in the circumference direction nearby the inner wall 19 at the bottom side of the tubular portion 11 (See FIG. 21 for example). The bottom cathode 21 may be a ring-like electrode positioned at the bottom side of the electroplating tank 10. In a case where the bottom cathode 21 includes a ring-like electrode, sufficient contact between the base member 51 and the bottom cathode 21 may be ensured as the multiple of base members 51 flows in the circumference direction. Note that the circumference direction is a direction directed along an inner wall 19 of the electroplating tank 10, and should not be limited to a direction based on a perfect circle shape and could include any direction based on an oval or other shapes. It should be noted that a bottom cathode may preferably be shaped like a ring, but could be any shapes like a bar, a plate or sphere and so on. A whole or part of the bottom portion 12 of the electroplating tank 10 can be a cathode.

The top anode 22 extends in the circumference direction, and therefore a difference in growth rate of electroplated layer in the circumference direction may be avoided or suppressed. More particularly, the top anode 22 extends along the circumference direction at the side of the opening 18 of the tubular portion 11. The top anode 22 is a ring-like electrode positioned at the top portion of the electroplating tank 10. In some cases, the top anode 22 is a metal wire and easily replaceable for a new metal wire, not necessarily limited to though. In another example, the top anode 22 may be like a sphere, a plate or a chip. Various types of metal and material can be adopted for the top anode 22. For example, it may be one or more metal selected from a group of a carbon, stainless steel, copper, tin, zinc, brass, titanium, gold, silver, nickel, chromium, lead, palladium, cobalt, platinum, ruthenium, and rhodium. As electroplating progresses, the top anode 22 elutes into the electrolytic solution, and its volume and weight will be reduced as time progresses. It should be noted an anode or cathode extending in the circumference direction does not mean a perfect circle, but includes a manner where an electrode is arranged in the circumference direction partially intermittently.

A desired finish color may be achieved by properly adjusting a type of metal material of the top anode 22 and composition of electrolytic solution. For example, the base member 51 is covered by an electroplated layer having a color of gold, black, silver, light copper, deep copper, or brown.

Various types of metal can be adopted for the bottom cathode 21. For example, it may be one or more metal selected from a group of stainless steel, copper, tin, zinc, stainless steel, carbon, titanium, gold, silver, nickel, chromium, lead, palladium, cobalt, platinum, ruthenium, and rhodium. An electroplated layer grows either on the bottom cathode 21. Therefore, in some cases, the electroplated layer is removed or the bottom cathode 21 is replaced at an appropriate timing.

The electroplating apparatus 1 further has a lid 15 in some cases. The lid 15 is provided with openings allowing a cable to pass there-through which is coupled to the top anode 22. The height of the top anode 22 in a depth direction of the electroplating tank 10 is determined by defining a spacing between the lid 15 and the top anode 22. In other words, a lid 15 is placed on the electroplating tank 10 so that the top anode 22 is positioned at an appropriate height in the electroplating tank 10.

In some cases of exemplary FIG. 20, a multiple of magnetic media 30 is thrown into the electroplating tank 10 additionally to the multiple of base members 51. As described above, the agitation mechanism 40 of FIG. 20 does not directly affect the base members 51 to flow the base members 51, but affects the base members 51 via the multiple of magnetic media 30. In some cases, one piece of magnetic media 30 is sufficiently small compared to one piece of base member 51. A type of magnetic media 30 may be various. As an example, the magnetic media 30 can be bar-like members or needle-like members. In another example, the magnetic media 30 may be like a sphere, a rectangular solid, a cube, or a pyramid. The magnetic media 30 can typically be made of stainless steel, but not necessarily limited to though. When the magnetic media 30 is a bar-like or needle-like stainless steel member, at the time of collision with the base members 51, an outermost surface of electroplated layer of the base member 51 can be effectively polished. It should be noted that a top anode 22 may be hanged by a bar member without using the lid 15.

In some cases of exemplary FIG. 20, a flow of the multiple of base members 51 along the circumference direction is caused by the agitation mechanism 40 magnetically affecting the multiple of magnetic media 30 in the electrolytic solution in the electroplating tank 10 to cause the multiple of magnetic media 30 to flow in the circumference direction. The flow of the multiple of base members 51 in the circumference direction is caused together with the flow of the magnetic media 30 in the electrolytic solution in the electroplating tank 10 along the circumference direction. When the magnetic media 30 flows in the circumference direction, the magnetic media 30 has an impetus greater than that of the base member 51. Effective polishing of growing electroplated layer is facilitated.

In some cases, the agitation mechanism 40 has an electrically powered motor 41, a rotational axis 42, a rotating plate 43, and one or more permanent magnets 44. Rotational force generated by the electrically powered motor 41 is directly or indirectly transmitted to the rotational axis 42, and the rotating plate 43 fixed to the rotational axis 42 rotates and the permanent magnet 44 provided on the rotating plate 43 rotates in the circumference direction. It is envisaged that a torque transmission system, ex. an endless belt and so on is provided between the electrically powered motor 41 and the rotational axis 42. A specific configuration of the agitation mechanism 40 would be determined properly by a skilled person in the art.

In some cases, the agitation mechanism 40 can include a magnetic circuit. By properly designing a magnetic circuit, the magnetic media 30 may flow in the circumference direction without rotating any physical members.

The permanent magnet 44 is fixed to the top surface of the rotating plate 43 such that N-pole is upwardly directed in a vertical direction, for example. The magnetic media 30 is attracted by the permanent magnet 44. Therefore, the permanent magnet 44 is entrained by the magnetic media 30 as the permanent magnet 44 moves in the circumference direction. As such, the flow of the magnetic media 30 in the circumference direction is caused, and thus the flow of the base members 51 in the circumference direction is caused.

In some cases of exemplary FIG. 24, the agitation unit 46 includes a disk portion 461 configuring at least a portion of the bottom portion of the electroplating tank 10, and a rotational axis 462 coupled to the disk portion 461. The top surface of the disk portion 461 matches the bottom surface of the bottom portion 12 of the electroplating tank 10. The center of the top surface of the disk portion 461 is provided with a projection 464 projecting upward in a vertical direction. As exemplarily illustrated in FIG. 25, a radial array of blades 463 is provided on the top surface of the disk portion 461 which are projecting upwardly, i.e. upwardly in a vertical direction. The blades 463 are arranged radially around the center of the disk portion 461.

A flow of the multiple of base members 51 along the circumference direction is caused in association with rotation of the agitation unit 46 provided at the bottom side of the electroplating tank 10. When the agitation unit 46 rotates around the rotational axis AX5, the blades 463 also rotates around the rotational axis AX5. When focusing on one blade 463, the one blade 463 moves along the circumference direction, causing a flow of electrolytic solution and causing a flow of base members 51 along the circumference direction. The blade 463 may directly touch or hit the base members 51. In some cases, the blade 463 has a lower height from the top surface of the disk portion 461. This facilitates smooth rotation of the agitation unit 46. As such, uniform agitation of base members 51 inside of the electroplating tank 10 is facilitated. Note that the tubular portion 11 of the electroplating tank 10 is a stationary member.

A slant portion provided on a radially outer region of the disk portion 461 is provided on a flange portion 119 extending radially inwardly and provided at the bottom end of the tubular portion 11 of the electroplating tank 10. A non-illustrated drain pipe is connected to a space between the slant portion of the disk portion 461 and the flange portion 119. The electrolytic solution in the electroplating tank 10 can be drained by opening and closing the drain pipe.

The torque-supply mechanism 47 includes an electrically powered motor 41 and a motive power transmission belt 472. A torque is transmitted from the electrically powered motor 471 to the rotational axis 462 of the agitation unit 46 via the motive power transmission belt 472. Accordingly, the rotational axis 462 rotates, the disk portion 461 coupled to the rotational axis 462 rotates, and the blade 463 on the top surface of the disk portion 461 moves along the circumference direction. Accordingly, a multiple of base members 51 that has been immersed down onto the disk portion 461 of the agitation unit 46 in the electrolytic solution of the electroplating tank 10 freely moves along the circumference direction.

In some cases, as would be understood from examples of FIGS. 21 and 22, a low-friction member 13 is provided on the bottom surface at the bottom portion 12 radially inwardly of the bottom cathode 21. This facilitates the flow of the base members 51 on the bottom portion 12. In some cases, additionally or alternatively, the low-friction member is provided on the inner wall 19 of the electroplating tank 10. For example, the low-friction member is a resin-made sheet such as a polyethylene, polypropylene, polyvinyl chloride, or polyurethane, for example.

In some exemplary embodiments of FIGS. 20 and 24, agitation and electroplating are performed simultaneously in the electroplating apparatus 1. During agitation step, surfaces of base members 51 are polished and surfaces of electroplated layer 52 on the base members 51 are polished. In an apparatus of FIG. 20, the magnetic media 30 collides with the base members 51, and additionally the base members 51 collide with one another, thereby electroplating progresses while surface conditions are being affected. Accordingly, it is considered that a continuous change of the ratio of the second electroplated layer-metallic element illustrated above is caused. In the apparatus of FIG. 24 either, rotational number is regulated and the base members 51 collide with one another at a given or greater frequency so that electroplating progresses while surface conditions are being affected. Accordingly, it is considered that a continuous change of the ratio of the second electroplated layer-metallic element illustrated above is caused. Note that the electroplated layer shown in FIGS. 4, 11, 12, and 16-18 are formed by the electroplating apparatus 1 of FIGS. 20. The electroplated layer of FIGS. 13 and 14 is formed by the electroplating apparatus 1 of FIG. 24.

It may be seen that polishing of the electroplated layers while the electroplated layers are growing is against an initial object for growing the electroplated layer. However, in a case where the electroplated layers are polished while the electroplated layers grow, a degree of flatness is enhanced at thin thickness range of electroplated layer. As a result, this may result in that thin electroplated layers are obtained with a desired finish appearance, in other words with a desired flatness or gloss. Thinning of electroplated layer may result in reduced time and power required for electroplating, and may results in remarkably reduced product unit price of electroplated article 5 and/or costumery part 7.

In some cases, at initial phase of agitation and electroplating step, a degree of flatness of the surface of the base members 51 is very low. Therefore, a multiple of base members 51 that has been immersed in the solution of the electroplating tank 10 does not flow due to contact drag with other neighboring base members 51 regardless of collision with magnetic media 30. Even in such a case, a degree of flatness of the outermost surface of base members 51 is increased together with increase of number of collisions with magnetic media 30, increase of number of collisions between base members 51, and growth of electroplated layer as time progresses, and thus facilitating the flow of the multiple of base members 51.

A supplementary description on above point will be followed with reference to FIG. 23. As time t1, a switch of power source 90 is turned ON, and a voltage is applied between the bottom cathode 21 and the top anode 22. Also, at time t1, the electrically powered motor 471 is turned into an ON-state, and the rotational axis 42 rotates, and permanent magnet 44 rotates along the circumference direction. The magnetic media 30 is entrained by the permanent magnet 44 and flows along the circumference direction. The base members 51 are pushed by the magnetic media 30 and receive force for flowing in the circumference direction. However, at an interval between t1 and t2, contact drag between base members 51 is too huge to cause the flow of the base members 51 in the circumstance direction. That is, the maximum rpm (revolutions per minute) of base members 51 is substantially zero.

In an interval between time t1 and time t2, contacts and collisions between base members 51 are repeated, and contacts and collisions between base members 51 and magnetic media 30 are repeated, and an electroplated layer grows on the outermost surface of base members 51, thereby a degree of flatness of base members 51 is increased. As a result, after time t2, the multiple of base members 51 gradually starts to flow along the circumference direction. After time t3, the multiple of base members 51 significantly flows along the circumference direction. After time t4, flow of the multiple of base members 51 along the circumference direction is stabled.

In FIG. 23, some variations of change of the maximum rpm is shown by a solid line, one-dotted broken line, and two-dotted broken line. The change of the maximum rpm may depend on the geometric shape of the electroplating tank 10, capacity of the electroplating tank 10, the number or weight of base members 51 thrown into an electroplating tank 10, and/or a rotational number of electrically powered motor 41, the number or arrangement of permanent magnets 44. The end time of this agitation and electroplating will be appropriately set by a skilled person in the art through experimentations.

Note that rpm may be calculated as follows, for example. Firstly, a moving distance of a particular base member 51 in the circumference direction per unit of time is measured. Next, it is converted into a distance per a minute. The rpm can be determined as such. In terms of the maximum rpm, it is assumed that 10 pieces of base members 51 are sampled which are flowing relatively faster when being viewed by human eyes, for example. That is, it is not realistic that rpm is calculated for every piece of the multiple of base members 51. Therefore, the maximum rpm indicates the maximum value of rpm calculated for the specific 10 pieces of base members 51. The determination and construction of the maximum rpm pointed out in claims should be based on a method described in this paragraph.

In some cases, a direction of flow of base members 51 is reversed during agitation. Accordingly, it is possible to facilitate to reduce or avoid that the base members 51 gather on the bottom portion 12 of the electroplating tank 10. For example, rotation of the electrically powered motor 41 is stopped during agitation, and a direction of rotation of the electrically powered motor 471 is reversed. Accordingly, it is possible to facilitate to reduce or avoid that the base members 51 gather on the bottom portion 12 of the electroplating tank 10. In a method where base members 51 flow based on received force by the magnetic media 30, agitation force for base members is not easily obtained and in some cases, it is not easy to agitate the base members 51 equally. Such problem may be avoided or suppressed by the agitation mechanism 40 performing stop and/or reverse of agitation during agitation step.

When the maximum rpm of the base member 51 is great, it is envisaged that, as the base members 51 move radially outwardly in accordance with centrifugal force, a chance of contact with the bottom cathode 21 of the electroplating tank 10 is increased. However, when the maximum rpm of the base member 51 is great, it is afraid that a chance of power non-supply condition of base members 51 is increased. If a chance of power non-supply condition of base members 51 was increased, then this might result in a variation of thickness of electroplated layer of the respective base members 51 in the multiple of base members 51. In view of this point, in the present embodiment, the maximum rpm of base members 51 inside of an electroplating tank 10 is maintained less than an optimum value. Accordingly, variation of electroplated layer thickness can be effectively lowered. It should be noted that base members 51 in power non-supply condition indicates base members 51 which are not in direct contact with the bottom cathode 21 and are not electrically connected to the bottom cathode 21 via other base members 51. As would be obvious for a skilled person in the art, the base members 51 in power non-supply condition would suffer a bipolar phenomenon.

For maintaining the substantially submerged condition, lighter the weight of base members to be thrown-in at one time would be, lower the rotational number of agitation would be; or rotational radius of the base members or inner radius of the electroplating tank 10 may be set for that purpose.

The maximum rotational speed (rpm) of base members 51 in the electroplating tank 10 may preferably be a rotational number that is sufficient to maintain the substantially submerged condition of base members 51. The rotational speed of base members 51 changes in accordance with an input volume of base members 51 but, in this case either, the input volume and rotational number may preferably be set such that the substantially submerged condition is maintained. In some cases, the electroplating solution has 20 to 30 liter, and the input volume of base members 51 is 10 gram to 8000 gram, and magnetic media of roughly 50 cc to 400 cc is placed into an electroplating tank.

In some cases, in the type of electroplating apparatus shown in FIG. 20, the maximum rpm of base members 51 in the electroplating tank 10 is maintained to be less than 40 rpm. Variation of electroplated layer thickness is thus effectively lowered.

In some cases, in the type of electroplating apparatus shown in FIG. 20, the maximum rpm of base members 51 in the electroplating tank 10 is maintained to be less than 30 rpm or 25 rpm or 20 rpm or 15 rpm or 10 rpm.

In some cases, in the type of electroplating apparatus shown in FIG. 24, the maximum rpm of base members 51 in the electroplating tank 10 is maintained to be less than 120 rpm. Variation of electroplated layer thickness is thus effectively lowered.

In some cases, in the type of electroplating apparatus shown in FIG. 24, the maximum rpm of base members 51 in the electroplating tank 10 is maintained to be less than 100 rpm or 80 rpm or 70 rpm or 60 rpm or 50 rpm. Note that, in a type of electroplating apparatus shown in FIG. 24, as described above, chance of collisions between base members 51 may be regulated by setting the rotational speed, but it is possible to add media for polishing and cause collisions between the polishing media and base members 51.

In some cases of exemplary FIG. 26, a hollow or non-hollow cylinder is provided at the center of the electroplating tank 10. Owing to this cylinder, a flow path of base members 51 is restricted to a radial outward side, i.e. over the bottom cathode 21. This may lower a chance of power non-supply condition of base members 51. Note that the cylinder is non-conductive and non-magnetic. Even in such a case, a similar description to above description would be effective.

FIG. 27 shows an example where bottom cathode 21 and top anode 22 are arranged differently. The bottom cathode 21 is a circular wire. Similarly, the top anode 22 is a circular wire. The bottom cathode 21 is fixed adjacent to the inner wall 19 at the bottom side of the electroplating tank 10. The top anode 22 is fixed adjacent to the inner wall 19 at the side of opening 18 of the electroplating tank 10. Even in such a case, a similar description to above description would be effective.

In some cases of exemplary FIG. 28, the agitation unit 46 and/or the disk portion 461 is like a flat plate. Moreover, the bottom cathode 21 is arranged on the above-described flange portion 119. Even in such a case, a similar description to above description would be effective.

Figure 29:
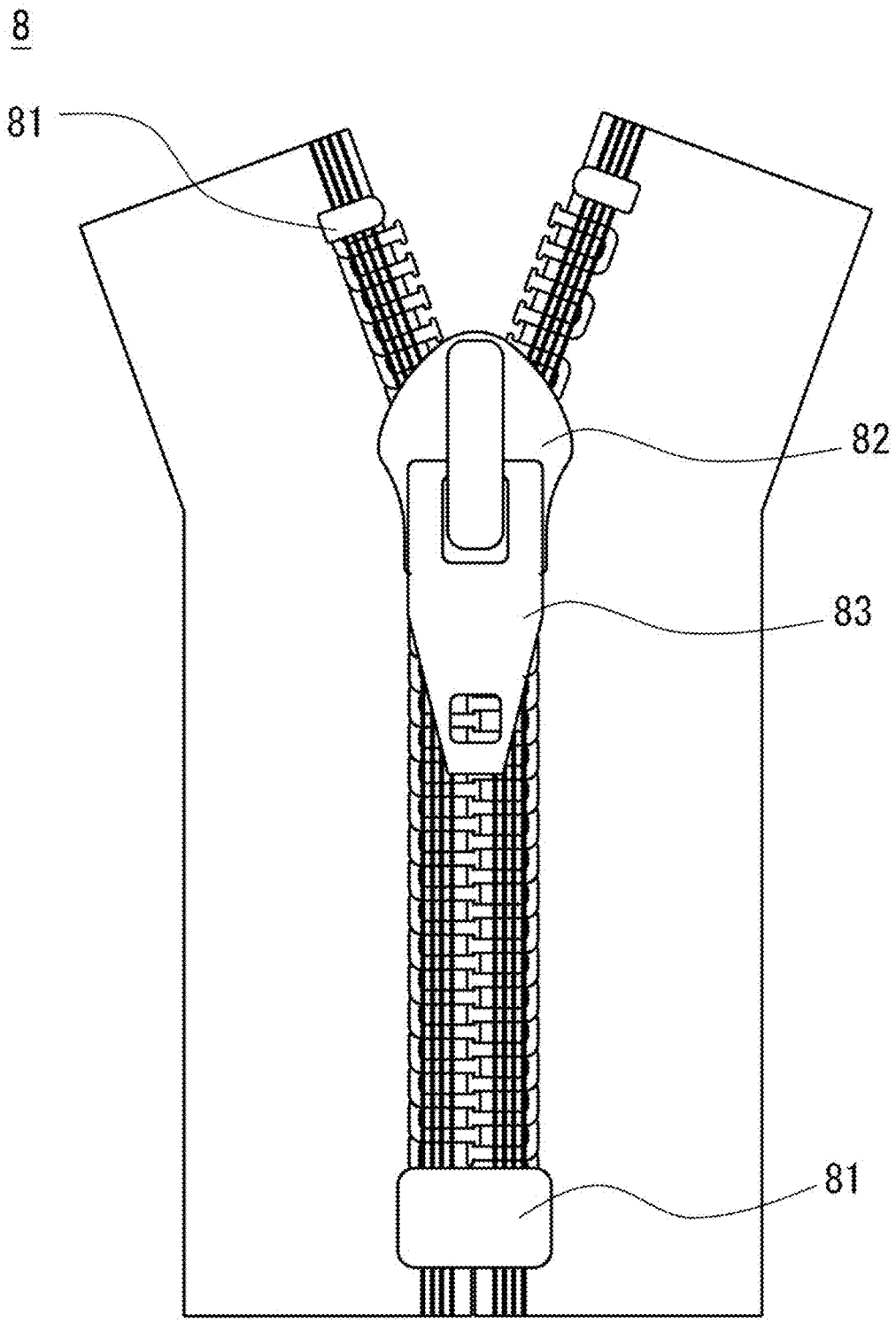
FIG. 29 is a schematic elevational view of a slide fastener which is seen to understand a variation of electroplated articles.

FIG. 29 is a schematic elevational view of a slide fastener which is seen to understand a variation of electroplated articles. An electroplated article 5 may be a metallic part included in a slide fastener 8 such as a stop 81, slider 82, and pull-tab 83, for example.

Working Example 1

Working example 1 relates to an example where magnetic media is used as described with reference to FIG. 20. An electroplating tank having a radius of 300 mm, depth of 150 mm, i.e. capacity of 40 liter was used. The electroplating tank was made of metal. A rubber sheet was attached to an inner circumference surface of a tubular portion of the electroplating tank, and a low-friction member made of polyethylene was attached to a bottom portion of the electroplating tank. An exposed portion between the rubber sheet and the low-friction member was used as a cathode. That is, a portion of the electroplating tank provides a cathode. The cathode was configured to be continuous circle in the circumstance direction. The anode was immersed in the solution in a hanged style. A copper wire was used as an anode. Stainless-steel pins were used as magnetic media. A size of one stainless-steel pin was a length of 5 mm and a diameter of 0.5 mm. Stainless-steel pins of 100 cc were added into the electroplating tank. Shells for button were used as base members. The shell was made of brass (Cu: Zn=65:35). The shell had been processed through degreasing and washing steps. An amount of thrown-in shells was 1 kg. A rotational speed of electrically powered motor was 1800 rpm. A rotational speed of solution was 30 rpm. A rotational speed of solution can be determined based on observation of a flowing pointer. A rotational speed of shells was less than 40 rpm. It was observed that substantial shells were in power-supply condition and uniform thickness of electroplated layer was formed.

Working Example 2

The same holds true as the working example 1 except that shells of 2 kg were thrown-in and stainless-steel pins of 200 cc were thrown-in. It was observed that substantial shells were in power-supply condition and uniform thickness of electroplated layer was formed.

Working Example 3

The same holds true as the working example 1 except that shells of 3 kg were thrown-in, stainless-steel pins of 250 cc were thrown-in, and direction of rotation of electrically powered motor was reversed intermittently by 30 seconds. It was observed that substantial shells were in power-supply condition and uniform thickness of electroplated layer was formed. However, a part of shells did not flow finely, and thus it was expected that color unevenness was formed in the electroplated layer, not confirmed though.

Similar result was obtained when similar experimentation was performed for sliders for slide fastener as replacement of shells.

In the above disclose, an electroplated article defined as below is disclosed.

APPENDIX 1

An electroplated article comprising:

a base member that includes one or more base member-metallic elements; and an electroplated layer that is formed directly on the base member, wherein the electroplated layer includes at least a first electroplated layer-metallic element and a second electroplated layer-metallic element that is different from the first electroplated layer-metallic element, wherein the second electroplated layer-metallic element is a metallic element that is identical to at least one of the one or more base member-metallic elements, and wherein a ratio of the second electroplated layer-metallic element in the electroplated layer is continuously decreased as being away from the base member in the thickness direction of the electroplated layer and/or a clear interface does not exist between the base member and the electroplated layer Features as defined in Claims 9-19 at the time of filling are effective for the electroplated article of Appendix 1.

In the above disclosure, it has been described that the base member includes one or more base member-metallic elements, and the electroplated layer includes at least first and second electroplated layer-metallic elements. If desired or if necessary, the base member-metallic element, the first electroplated layer-metallic element and the second electroplated layer-metallic element may be referred to a first metallic element, a second metallic element, and third metallic element alternatively. In such a case, the invention described in Claim may be redefined as shown by the following Appendix.

APPENDIX 2

An electroplated article comprising:

a base member that includes one or more first metallic elements: and an electroplated layer that is formed directly on the base member, wherein the electroplated layer includes at least a second metallic element and a third metallic element that is different from the second metallic element, wherein the third metallic element is a metallic element that is identical to at least one of the one or more first metallic elements, and wherein a ratio of the third metallic element in the electroplated layer is continuously decreased as being away from the base member in the thickness direction of the electroplated layer and/or a clear interface does not exist between the base member and the electroplated layer.

Features as defined in Claims 9-19 at the time of filling of this application are effective for the electroplated article of Appendix 2 with a necessary replacement of terms.

In the above disclosure, it has been described that the feature of "a ratio of the second electroplated layer-metallic element in the electroplated layer is continuously decreased as being away from the base member in the thickness direction of the electroplated layer and/or a clear interface does not exist between the base member and the electroplated layer" has been described as one of some key features. However, it should be noted that this key feature is not superior to or is not a premise of other features. For example, the following inventions could be understandable.

APPENDIX 3

An electroplated article comprising:

a base member; and an electroplated layer that is formed directly on the base member, wherein the electroplated layer has an opposite surface that is positioned opposite to the base member, and particle-like portions and/or nubby portions are two-dimensionally densely formed in the opposite surface.

APPENDIX 4

The electroplated article of Appendix 3, wherein there is substantially no crack or pin-hole in the opposite surface.

APPENDIX 5

The electroplated article of Appendix 3 or 4, wherein the base member includes one or more base member-metallic elements, wherein the electroplated layer includes at least a first electroplated layer-metallic element and a second electroplated layer-metallic element that is different from the first electroplated layer-metallic element, wherein the second electroplated layer-metallic element is a metallic element that is identical to at least one of the one or more base member-metallic elements, and wherein a ratio of the second electroplated layer-metallic element in the electroplated layer is continuously decreased as being away from the base member in the thickness direction of the electroplated layer and/or a clear interface does not exist between the base member and the electroplated layer.

Given the above teachings, a skilled person in the art would be able to add various modifications to the respective embodiments. Reference codes in Claims are just for reference and should not be referenced for purposes of narrowly construing the scope of claims.

REFERENCE SIGNS LIST

5 Electroplated article
51 Base member
52 Electroplated layer

The invention claimed is:

1. A method for electroplating, comprising:

agitating a multiple of base members immersed in an electrolytic solution inside of an electroplating tank to flow in a circumferential direction along an inner wall of the electroplating tank; and electroplating the multiple of base members flowing along the circumferential direction in the electrolytic solution inside of the electroplating tank, wherein the flow of the multiple of base members is caused by a flow of magnetic media along the circumferential direction in the electrolytic solution inside of the electroplating tank or is caused by rotation of an agitation unit provided at a bottom side of the electroplating tank, wherein the multiple of base members flow in the circumferential direction in the electrolytic solution inside of the electroplating tank such that at least one of the multiple of base members that is flowing along the circumferential direction in the electrolytic solution directly touches a bottom cathode provided at a bottom side of the electroplating tank and is electroplated, and a base member positioned at an upper position relative to said base member directly touching the bottom cathode is electrically connected to the bottom cathode via at least said base member directly touching the bottom cathode and is electroplated, wherein said agitating and said electroplating are performed simultaneously during a given time window such that the multiple of base members are electroplated to have a common single color.

2. The method for electroplating of claim 1, wherein the bottom cathode extends along the circumferential direction and/or a top anode associated with the bottom cathode extends along the circumferential direction.

3. The method for electroplating of claim 1, wherein the electroplating tank includes a tubular portion, and the tubular portion is a stationary member.

4. The method for electroplating of claim 1, wherein the magnetic media are bar-like or needle-like members.

5. The method for electroplating of claim 1, wherein a maximum rpm of the multiple of base members inside of the electroplating tank is less than 40 rpm.

6. The method for electroplating of claim 1, wherein the multiple of base members includes first and second subsets temporarily grouped, said at least one of the multiple of base members included in the first subset of the multiple of base members and not included in the second subset of the multiple of base members.

7. The method for electroplating of claim 1, wherein said agitating is performed to allow respective base members of the multiple of base members to collide with one another.

8. A method of producing electroplated articles through the method of claim 1, the electroplated articles produced through said agitating and said electroplating simultaneously performed.

9. A method for electroplating, comprising:

agitating multiple base members immersed in an electrolytic solution inside of an electroplating tank to flow in a circumferential direction along an inner wall of the electroplating tank; and electroplating the multiple base members flowing along the circumferential direction in the electrolytic solution inside of the electroplating tank, wherein the flow of the multiple base members is caused by a flow of magnetic media along the circumferential direction in the electrolytic solution inside of the electroplating tank or is caused by rotation of an agitation unit provided at a bottom side of the electroplating tank, wherein the multiple base members flow in the circumferential direction in the electrolytic solution inside of the electroplating tank such that at least one of the multiple base members that is flowing along the circumferential direction in the electrolytic solution directly touches a bottom cathode provided at a bottom side of the electroplating tank and is electroplated, and a base member positioned at an upper position relative to said base member directly touching the bottom cathode is electrically connected to the bottom cathode via at least said base member directly touching the bottom cathode and is electroplated, wherein each of the base members includes one or more base member-metallic elements, wherein an electroplated layer is formed directly on the base member by said electroplating, the electroplated layer including at least a first electroplated layer-metallic element and a second electroplated layer-metallic element that is different from the first electroplated layer-metallic element, wherein the second electroplated layer-metallic element is a metallic element that is identical to at least one of the one or more base member-metallic elements, and wherein a ratio of the second electroplated layer-metallic element in the electroplated layer is continuously decreased as being away from the base member in a thickness direction of the electroplated layer and/or a clear interface does not exist between the base member and the electroplated layer in a TEM image.

10. The method for electroplating of claim 9, wherein one or more of conditions (a)-(g) are satisfied:

(a) a thickness of a portion of the electroplated layer where the ratio of the second electroplated layer-metallic element is continuously decreased as being away from the base member in the thickness direction thereof is equal to or greater than 10 nm;

(b) a thickness of a portion of the electroplated layer where the ratio of the second electroplated layer-metallic element is continuously decreased as being away from the base member in the thickness direction thereof is equal to or less than 80 nm or 60 nm or 30 nm or 20 nm;

(c) a ratio of the first electroplated layer-metallic element at a surface of the electroplated layer is less than 100%;

(d) a ratio of the first electroplated layer-metallic element in the electroplated layer is decreased as being closer to the base member in the thickness direction of the electroplated layer;

(e) a thickness of the electroplated layer is equal to or less than 150 nm;

(f) the base member is metal or alloy at least including copper as the one or more of the base member-metallic elements; and (g) the electroplated layer is metal or alloy at least including tin as the first electroplated layer-metallic element.

11. The method for electroplating of claim 10, wherein one or both of conditions of (h) and (i) are satisfied:

(h) the electroplated layer has an opposite surface that is positioned opposite to the base member, and wherein decrease of the ratio of the second electroplated layer-metallic element in the electroplated layer continues up to the opposite surface or to proximity of the opposite surface in the thickness direction of the electroplated layer; and (i) the electroplated layer has an opposite surface that is positioned opposite to the base member, and wherein particle-like portions and/or nubby portions are two-dimensionally formed in the opposite surface.

* * * * *